US009361904B2

(12) United States Patent
Liu et al.

(10) Patent No.: US 9,361,904 B2
(45) Date of Patent: Jun. 7, 2016

(54) METHOD FOR PREDICTING BANDWIDTH EXTENSION FREQUENCY BAND SIGNAL, AND DECODING DEVICE

(71) Applicant: Huawei Technologies Co., Ltd., Shenzhen (CN)

(72) Inventors: Zexin Liu, Beijing (CN); Lei Miao, Beijing (CN); Fengyan Qi, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 14/806,896

(22) Filed: Jul. 23, 2015

(65) Prior Publication Data

US 2015/0332688 A1 Nov. 19, 2015

Related U.S. Application Data

(63) Continuation of application No. PCT/CN2013/079883, filed on Jul. 23, 2013.

(30) Foreign Application Priority Data

Jan. 29, 2013 (CN) ..... 2013 1 0034240

(51) Int. Cl.
*G10L 19/00* (2013.01)
*G10L 21/038* (2013.01)
(Continued)

(52) U.S. Cl.
CPC ..... *G10L 21/038* (2013.01); *G10L 19/02* (2013.01); *G10L 19/08* (2013.01)

(58) Field of Classification Search
USPC ..... 704/500–504
See application file for complete search history.

(56) References Cited

U.S. PATENT DOCUMENTS 8,244,547 B2 * 8/2012 Sudo ..... G10L 21/038 704/203
8,639,500 B2 * 1/2014 Choo ..... G10L 21/038 704/219

(Continued)

FOREIGN PATENT DOCUMENTS

CN 101140759 A 3/2008
CN 101853664 A 10/2010

(Continued)

OTHER PUBLICATIONS

Foreign Communication From A Counterpart Application, Korean Application No. 10-2015-7022769, Korean Office Action dated Oct. 23, 2015, 5 pages.

(Continued)

*Primary Examiner* — Leonard Saint Cyr
(74) *Attorney, Agent, or Firm* — Conley Rose, P.C.; Grant Rodolph

(57) ABSTRACT

A method for predicting a bandwidth extension frequency band signal includes demultiplexing a received bitstream to obtain a frequency domain signal; determining whether a highest frequency bin, to which a bit is allocated, of the frequency domain signal is less than a preset start frequency bin of a bandwidth extension frequency band; predicting an excitation signal of the bandwidth extension frequency band according to the determination; and predicting the bandwidth extension frequency band signal according to the predicted excitation signal of the bandwidth extension frequency band and a frequency envelope of the bandwidth extension frequency band.

20 Claims, 5 Drawing Sheets

(51) Int. Cl.
*G10L 19/02* (2013.01)
*G10L 19/08* (2013.01)

(56) References Cited

U.S. PATENT DOCUMENTS

| | | | | |
|---|---|---|---|---|
| 9,015,041 | B2 * | 4/2015 | Bayer | G10L 19/002 704/201 |
| 2004/0243402 | A1 | 12/2004 | Ozawa | |
| 2008/0120117 | A1 * | 5/2008 | Choo | G10L 21/038 704/500 |
| 2010/0057476 | A1 * | 3/2010 | Sudo | G10L 21/038 704/500 |
| 2010/0094638 | A1 | 4/2010 | Lee et al. | |
| 2011/0288873 | A1 | 11/2011 | Nagel et al. | |
| 2011/0295598 | A1 * | 12/2011 | Yang | G10L 21/038 704/205 |
| 2013/0317831 | A1 | 11/2013 | Liu et al. | |

FOREIGN PATENT DOCUMENTS

| | | | |
|---|---|---|---|
| CN | 102194457 | A | 9/2011 |
| CN | 102610231 | A | 7/2012 |
| EP | 2186086 | B1 | 1/2013 |
| KR | 20080059279 | A | 6/2008 |
| WO | 2007052088 | A1 | 5/2007 |
| WO | 2012095700 | A | 7/2012 |

OTHER PUBLICATIONS

Foreign Communication From A Counterpart Application, Korean Application No. 10-2015-7022769, English Translation of Korean Office Action dated Oct. 23, 2015, 4 pages.

Partial English Translation and Abstract of Chinese Patent Application No. CN101140759, Oct. 23, 2015, 12 pages.

"Series G: Transmission Systems and Media, Digital Systems and Networks, Digital terminal equipments—Coding of voice and audio signals, Wideband embedded extension for G.711 pulse code modulation, Amendment 5: New Appendix IV extending Annex D superwideband for mid-side stereo," ITU-T, G.711.1, Amendment 5, Mar. 2011, 12 pages.

"Series G: Transmission Systems and Media, Digital Systems and Networks, Digital terminal equipments—Coding of voice and audio signals, 7 kHz audio-coding within 64 kbit/s, Amendment 1: New Annex B with superwideband embedded extension," ITU-T, G.722, Amendment 1, Nov. 2010, 96 pages.

Foreign Communication From A Counterpart Application, PCT Application No. PCT/CN2013/079883, English Translation of International Search Report dated Nov. 7, 2013, 2 pages.

Foreign Communication From A Counterpart Application, PCT Application No. PCT/CN2013/079883, English Translation of Written Opinion dated Nov. 7, 2013, 6 pages.

Zhan, J., et al., "Bandwidth Extensions for China AVS-M Standard," ICASSP, 2009, pp. 4149-4152.

Foreign Communication From A Counterpart Application, European Application No. 13873587.3, Partial Supplementary European Search Report dated Feb. 19, 2016, 7 pages.

* cited by examiner

METHOD FOR PREDICTING BANDWIDTH EXTENSION FREQUENCY BAND SIGNAL, AND DECODING DEVICE

CROSS-REFERENCE TO RELATED APPLICATIONS

This application is a continuation of International Application No. PCT/CN2013/079883, filed on Jul. 23, 2013, which claims priority to Chinese Patent Application No. 201310034240.9, filed on Jan. 29, 2013, both of which are hereby incorporated by reference in their entireties.

TECHNICAL FIELD

Embodiments of the present invention relate to the field of communications technologies, and in particular, to a method for predicting a bandwidth extension frequency band signal, and a decoding device.

BACKGROUND

In the field of digital communications, there are extremely widespread application requirements for voice, picture, audio, and video transmission, such as a phone call, an audio and video conference, broadcast television, and multimedia entertainment. To reduce a resource occupied in a process of storing or transmitting an audio and video signal, an audio and video compression and encoding technology comes into existence. Many different technical branches emerge in the development of the audio and video compression and encoding technology, where a technology in which a signal is encoded and processed after being transformed from a time domain to a frequency domain is widely applied due to a good compression characteristic, and the technology is also referred to as a domain transformation encoding technology.

An increasing emphasis is placed on audio quality in communication transmission; therefore, there is a need to increase quality of a music signal as much as possible on a premise that voice quality is ensured. Meanwhile, the amount of information of an audio signal is extremely rich; therefore, a code excited linear prediction (CELP) encoding mode of conventional voice cannot be adopted; instead, generally, to process the audio signal, a time domain signal is transformed into a frequency domain signal using an audio encoding technology of domain transformation encoding, thereby enhancing encoding quality of the audio signal.

In an existing audio encoding technology, generally, by adopting a transformation technology, such as a fast Fourier transform (FFT) or a modified discrete cosine transform (MDCT) or a discrete cosine transform (DCT), a high frequency band signal in an audio signal is transformed from a time domain signal to a frequency domain signal, and then, the frequency domain signal is encoded.

In the case of a low bit rate, limited quantization bits cannot quantize all to-be-quantized audio signals; therefore, an encoding device uses most bits to precisely quantize relatively important low frequency band signals in audio signals, that is, quantization parameters of the low frequency band signals occupy most bits, and only a few bits are used to roughly quantize and encode high frequency band signals in the audio signals to obtain frequency envelopes of the high frequency band signals. Then, the frequency envelopes of the high frequency band signals and the quantization parameters of the low frequency band signals are sent to a decoding device in a form of a bitstream. The quantization parameters of the low frequency band signals may include excitation signals and frequency envelopes. When being quantized, the low frequency band signals may first also be transformed from time domain signals to frequency domain signals, and then, the frequency domain signals are quantized and encoded into excitation signals.

Generally, the decoding device may restore the low frequency band signals according to the quantization parameters that are of the low frequency band signals and in the received bitstream, then acquire the excitation signals of the low frequency band signals according to the low frequency band signals, predict excitation signals of the high frequency band signals using a bandwidth extension (BWE) technology and a spectrum filling technology and according to the excitation signals of the low frequency band signals, and modify the predicted excitation signals of the high frequency band signals according to the frequency envelopes that are of the high frequency band signals and in the bitstream, to obtain the predicted high frequency band signals. Herein, the obtained high frequency band signals are frequency domain signals.

In the BWE technology, a highest frequency bin to which a bit is allocated may be a highest frequency bin to which an excitation signal is decoded, that is, no excitation signal is decoded on a frequency bin greater than the highest frequency bin. A frequency band greater than the highest frequency bin to which a bit is allocated may be referred to as a high frequency band, and a frequency band less than the highest frequency bin to which a bit is allocated may be referred to as a low frequency band. That an excitation signal of a high frequency band signal is predicted according to an excitation signal of a low frequency band signal may be as follows. The highest frequency bin to which a bit is allocated is used as a center, an excitation signal that is of the low frequency band signal and less than the highest frequency bin to which a bit is allocated is copied into a high frequency band signal that is greater than the highest frequency bin to which a bit is allocated and whose bandwidth is equivalent to bandwidth of the low frequency band signal, and the excitation signal is used as the excitation signal of the high frequency band signal.

In a process of implementing the present invention, the inventor finds that at least the following problem exists in the prior art. According to the foregoing method for predicting a bandwidth extension frequency band signal in the prior art, an excitation signal of a high frequency band signal is predicted according to an excitation signal of a low frequency band signal, excitation signals of different low frequency band signals may be copied into a same high frequency band signal in different frames, causing discontinuity of excitation signal and reducing quality of the predicted bandwidth extension frequency band signal, thereby reducing auditory quality of an audio signal.

SUMMARY

Embodiments of the present invention provide a method for predicting a bandwidth extension frequency band signal, and a decoding device, so as to improve quality of the predicted bandwidth extension frequency band signal, thereby enhancing auditory quality of an audio signal.

According to a first aspect, an embodiment of the present invention provides a method for predicting a bandwidth extension frequency band signal. The method includes demultiplexing a received bitstream and decoding the demultiplexed bitstream to obtain a frequency domain signal; determining whether a highest frequency bin, to which a bit is allocated, of the frequency domain signal is less than a preset start frequency bin of a bandwidth extension frequency band; when the highest frequency bin to which a bit is allocated is less than the preset start frequency bin of the bandwidth extension frequency band, predicting an excitation signal of the bandwidth extension frequency band according to an excitation signal within a predetermined frequency band range of the frequency domain signal and the preset start frequency bin of the bandwidth extension frequency band; when the highest frequency bin to which a bit is allocated is greater than or equal to the preset start frequency bin of the bandwidth extension frequency band, predicting the excitation signal of the bandwidth extension frequency band according to the excitation signal within the predetermined frequency band range of the frequency domain signal, the preset start frequency bin of the bandwidth extension frequency band, and the highest frequency bin to which a bit is allocated; and predicting the bandwidth extension frequency band signal according to the predicted excitation signal of the bandwidth extension frequency band and a frequency envelope of the bandwidth extension frequency band.

With reference to the first aspect, in a first implementation manner of the first aspect, predicting an excitation signal of the bandwidth extension frequency band according to an excitation signal within a predetermined frequency band range of the frequency domain signal and the preset start frequency bin of the bandwidth extension frequency band includes making n copies of the excitation signal within the predetermined frequency band range of the frequency domain signal, and using the n copies of the excitation signal as an excitation signal between the preset start frequency bin of the bandwidth extension frequency band and a highest frequency bin of the bandwidth extension frequency band, where n is an integer or a non-integer greater than 0, and n is equal to a ratio of a quantity of frequency bins between the preset start frequency bin of the bandwidth extension frequency band and the highest frequency bin of the bandwidth extension frequency band to a quantity of frequency bins within the predetermined frequency band range of the frequency domain signal.

With reference to the first aspect and the foregoing implementation manner of the first aspect, in a second implementation manner of the first aspect, making n copies of the excitation signal within the predetermined frequency band range of the frequency domain signal, and using the n copies of the excitation signal as an excitation signal between the preset start frequency bin of the bandwidth extension frequency band and a highest frequency bin of the bandwidth extension frequency band includes, when the prediction is started from the preset start frequency bin of the bandwidth extension frequency band, sequentially making integer copies in the n copies of the excitation signal within the predetermined frequency band range of the frequency domain signal and non-integer copies in the n copies of the excitation signal within the predetermined frequency band range of the frequency domain signal, and using the two parts of excitation signals as the excitation signal between the preset start frequency bin of the bandwidth extension frequency band and the highest frequency bin of the bandwidth extension frequency band, where the non-integer part of n is less than 1; or, when the prediction is started from the highest frequency bin of the bandwidth extension frequency band, sequentially making non-integer copies in the n copies of the excitation signal within the predetermined frequency band range of the frequency domain signal and integer copies in the n copies of the excitation signal within the predetermined frequency band range of the frequency domain signal, and using the two parts of excitation signals as the excitation signal between the preset start frequency bin of the bandwidth extension frequency band and the highest frequency bin of the bandwidth extension frequency band, where the non-integer part of n is less than 1.

With reference to the first aspect, in a third implementation manner of the first aspect, predicting the excitation signal of the bandwidth extension frequency band according to the excitation signal within the predetermined frequency band range of the frequency domain signal, the preset start frequency bin of the bandwidth extension frequency band, and the highest frequency bin, to which a bit is allocated, of the frequency domain signal includes making a copy of an excitation signal from the $m^{th}$ frequency bin $f_{exc_start}+$ above a start frequency bin $f_{exc_start}$ of the predetermined frequency band range of the frequency domain signal to an end frequency bin $f_{exc_end}$ of the predetermined frequency band range of the frequency domain signal and n copies of the excitation signal within the predetermined frequency band range of the frequency domain signal, and using the two parts of excitation signals as an excitation signal between the highest frequency bin, to which a bit is allocated, of the frequency domain signal and the highest frequency bin of the bandwidth extension frequency band, where n is 0 or an integer or a non-integer greater than 0, and m is a value of a quantity of frequency bins between the highest frequency bin to which a bit is allocated and the preset start frequency bin of the bandwidth extension frequency band.

With reference to the first aspect and the foregoing implementation manners of the first aspect, in a fourth implementation manner of the first aspect, making a copy of an excitation signal from the $m^{th}$ frequency bin $f_{exc_start}+$ above a start frequency bin $f_{exc_start}$ of the predetermined frequency band range of the frequency domain signal to an end frequency bin $f_{exc_end}$ of the predetermined frequency band range of the frequency domain signal and n copies of the excitation signal within the predetermined frequency band range of the frequency domain signal, and using the two parts of excitation signals as an excitation signal between the highest frequency bin, to which a bit is allocated, of the frequency domain signal and the highest frequency bin of the bandwidth extension frequency band includes, when the prediction is started from the highest frequency bin to which a bit is allocated, sequentially making a copy of the excitation signal from the $f_{exc_start}+$ (the highest frequency bin to which a bit is allocated−the preset start frequency bin of the bandwidth extension frequency band) to the $f_{exc_end}$ within the frequency band range of the frequency domain signal, integer copies in the n copies of the excitation signal within the frequency band range from the $f_{exc_start}$ to the $f_{exc_end}$ of the frequency domain signal, and non-integer copies in the n copies of the excitation signal within the frequency band range from the $f_{exc_start}$ to the $f_{exc_end}$ of the frequency domain signal, and using the three parts of excitation signals as the excitation signal between the highest frequency bin to which a bit is allocated and the highest frequency bin of the bandwidth extension frequency band, where the non-integer part of n is less than 1; or, when the prediction is started from the highest frequency bin of the bandwidth extension frequency band, sequentially making non-integer copies in the n copies of the excitation signal within the frequency band range from the $f_{exc_start}$ to the fexc_end of the frequency domain signal, integer copies in the n copies of the excitation signal within the frequency band range from the $f_{exc_start}$ to the $f_{exc_end}$ of the frequency domain signal, and a copy of the excitation signal from the $f_{exc_start}+$ (the highest frequency bin to which a bit is allocated−the preset start frequency bin of the bandwidth extension frequency band) to the $f_{exc_end}$ within the frequency band range of the frequency domain signal, and using the three parts of excitation signals as a high frequency excitation signal between the highest frequency bin to which a bit is allocated and the highest frequency bin of the bandwidth extension frequency band, where the non-integer part of n is less than 1.

With reference to the first aspect and the foregoing implementation manners of the first aspect, in a fifth implementation manner of the first aspect, before the predicting of the bandwidth extension frequency band signal according to the predicted excitation signal of the bandwidth extension frequency band and a frequency envelope of the bandwidth extension frequency band, the method further includes decoding the bitstream to obtain the frequency envelope of the bandwidth extension frequency band.

With reference to the first aspect and the foregoing implementation manners of the first aspect, in a sixth implementation manner of the first aspect, before the predicting of the bandwidth extension frequency band signal according to the predicted excitation signal of the bandwidth extension frequency band and a frequency envelope of the bandwidth extension frequency band, the method further includes decoding the bitstream to obtain a signal type; and acquiring the frequency envelope of the bandwidth extension frequency band according to the signal type.

With reference to the first aspect and the foregoing implementation manners of the first aspect, in a seventh implementation manner of the first aspect, acquiring the frequency envelope of the bandwidth extension frequency band according to the signal type includes, when the signal type is a non-harmonic signal, demultiplexing the received bitstream, and decoding the demultiplexed bitstream to obtain the frequency envelope of the bandwidth extension frequency band; or, when the signal type is a harmonic signal, demultiplexing the received bitstream, decoding the demultiplexed bitstream to obtain an initial frequency envelope of the bandwidth extension frequency band, and using a value that is obtained by performing weighting calculation on the initial frequency envelope and N adjacent initial frequency envelopes as the frequency envelope of the bandwidth extension frequency band, where N is greater than or equal to 1.

According to a second aspect, an embodiment of the present invention provides a decoding device, including a decoding module configured to demultiplex a received bitstream and decode the demultiplexed bitstream to obtain a frequency domain signal; a determining module configured to determine whether a highest frequency bin, to which a bit is allocated, of the frequency domain signal is less than a preset start frequency bin of a bandwidth extension frequency band; a first processing module configured to, when the determining module determines that the highest frequency bin to which a bit is allocated is less than the preset start frequency bin of the bandwidth extension frequency band, predict an excitation signal of the bandwidth extension frequency band according to an excitation signal within a predetermined frequency band range of the frequency domain signal and the preset start frequency bin of the bandwidth extension frequency band; a second processing module configured to, when the determining module determines that the highest frequency bin to which a bit is allocated is greater than or equal to the preset start frequency bin of the bandwidth extension frequency band, predict the excitation signal of the bandwidth extension frequency band according to the excitation signal within the predetermined frequency band range of the frequency domain signal, the preset start frequency bin of the bandwidth extension frequency band, and the highest frequency bin to which a bit is allocated; and a predicting module configured to predict a bandwidth extension frequency band signal according to the predicted excitation signal of the bandwidth extension frequency band and a frequency envelope of the bandwidth extension frequency band.

With reference to the second aspect, in a first implementation manner of the second aspect, the first processing module is configured to make n copies of the excitation signal within the predetermined frequency band range of the frequency domain signal and use the n copies of the excitation signal as an excitation signal between the preset start frequency bin of the bandwidth extension frequency band and a highest frequency bin of the bandwidth extension frequency band, where n is an integer or a non-integer greater than 0, and n is equal to a ratio of a quantity of frequency bins between the preset start frequency bin of the bandwidth extension frequency band and the highest frequency bin of the bandwidth extension frequency band to a quantity of frequency bins within the predetermined frequency band range of the frequency domain signal.

With reference to the second aspect and the foregoing implementation manner of the second aspect, in a second implementation manner of the second aspect, the first processing module is configured to, when the prediction is started from the preset start frequency bin of the bandwidth extension frequency band, sequentially make integer copies in the n copies of the excitation signal within the predetermined frequency band range of the frequency domain signal and non-integer copies in the n copies of the excitation signal within the predetermined frequency band range of the frequency domain signal, and use the two parts of excitation signals as the excitation signal between the preset start frequency bin of the bandwidth extension frequency band and the highest frequency bin of the bandwidth extension frequency band, where the non-integer part of n is less than 1; or the first processing module is configured to, when the prediction is started from the highest frequency bin of the bandwidth extension frequency band, sequentially make non-integer copies in the n copies of the excitation signal within the predetermined frequency band range of the frequency domain signal and integer copies in the n copies of the excitation signal within the predetermined frequency band range of the frequency domain signal, and use the two parts of excitation signals as the excitation signal between the preset start frequency bin of the bandwidth extension frequency band and the highest frequency bin of the bandwidth extension frequency band, where the non-integer part of n is less than 1.

With reference to the second aspect, in a third implementation manner of the second aspect, the second processing module is configured to make a copy of an excitation signal from the $m^{th}$ frequency bin above a start frequency bin $f_{exc_start}$ of the predetermined frequency band range of the frequency domain signal to an end frequency bin $f_{exc_end}$ of the predetermined frequency band range of the frequency domain signal and n copies of the excitation signal within the predetermined frequency band range of the frequency domain signal, and use the two parts of excitation signals as an excitation signal between the highest frequency bin, to which a bit is allocated, of the frequency domain signal and the highest frequency bin of the bandwidth extension frequency band, where n is 0 or an integer or a non-integer greater than 0, and m is a value of a quantity of frequency bins between the highest frequency bin to which a bit is allocated and the preset start frequency bin of the bandwidth extension frequency band.

With reference to the second aspect and the foregoing implementation manners of the second aspect, in a fourth implementation manner of the second aspect, the second processing module is configured to, when the prediction is started from the highest frequency bin to which a bit is allocated, sequentially make a copy of the excitation signal from the $f_{exc_start}$+ (the highest frequency bin to which a bit is allocated−the preset start frequency bin of the bandwidth extension frequency band) to the $f_{exc_end}$ within the frequency band range of the frequency domain signal, integer copies in the n copies of the excitation signal within the frequency band range from the $f_{exc_start}$ to the $f_{exc_end}$ of the frequency domain signal, and non-integer copies in the n copies of the excitation signal within the frequency band range from the $f_{exc_start}$ to the $f_{exc_end}$ of the frequency domain signal, and use the three parts of excitation signals as the excitation signal between the highest frequency bin to which a bit is allocated and the highest frequency bin of the bandwidth extension frequency band, where the non-integer part of n is less than 1; or the second processing module is configured to, when the prediction is started from the highest frequency bin of the bandwidth extension frequency band, sequentially make non-integer copies in the n copies of the excitation signal within the frequency band range from the $f_{exc_start}$ to the $f_{exc_end}$ of the frequency domain signal, integer copies in the n copies of the excitation signal within the frequency band range from the $f_{exc_start}$ to the $f_{exc_end}$ of the frequency domain signal, and a copy of the excitation signal from the $f_{exc_start}$+ (the highest frequency bin to which a bit is allocated−the preset start frequency bin of the bandwidth extension frequency band) to the $f_{exc_end}$ within the frequency band range of the frequency domain signal, and use the three parts of excitation signals as a high frequency excitation signal between the highest frequency bin to which a bit is allocated and the highest frequency bin of the bandwidth extension frequency band, where the non-integer part of n is less than 1.

With reference to the second aspect and the foregoing implementation manners of the second aspect, in a fifth implementation manner of the second aspect, the decoding module is further configured to, before the predicting module predicts the bandwidth extension frequency band signal according to the predicted excitation signal of the bandwidth extension frequency band and the frequency envelope of the bandwidth extension frequency band, decode the bitstream to obtain the frequency envelope of the bandwidth extension frequency band.

With reference to the second aspect and the foregoing implementation manners of the second aspect, in a sixth implementation manner of the second aspect, the device further includes an acquiring module, where the decoding module is further configured to, before the predicting module predicts the bandwidth extension frequency band signal according to the predicted excitation signal of the bandwidth extension frequency band and the frequency envelope of the bandwidth extension frequency band, decode the bitstream to obtain a signal type; and the acquiring module is configured to acquire the frequency envelope of the bandwidth extension frequency band according to the signal type.

With reference to the second aspect and the foregoing implementation manners of the second aspect, in a seventh implementation manner of the second aspect, the acquiring module is configured to, when the signal type is a non-harmonic signal, demultiplex the received bitstream and decode the demultiplexed bitstream to obtain the frequency envelope of the bandwidth extension frequency band; or the acquiring module is configured to, when the signal type is a harmonic signal, demultiplex the received bitstream, decode the demultiplexed bitstream to obtain an initial frequency envelope of the bandwidth extension frequency band, and use a value that is obtained by performing weighting calculation on the initial frequency envelope and N adjacent initial frequency envelopes as the frequency envelope of the bandwidth extension frequency band, where N is greater than or equal to 1.

According to the method for predicting a bandwidth extension frequency band signal, and the decoding device in the embodiments of the present invention, a start frequency bin of bandwidth extension is set, and a highest frequency bin to which a frequency domain signal is decoded and the start frequency bin are compared, to perform excitation restoration of a bandwidth extension frequency band, so that extended excitation signals are continuous between frames, and a frequency bin of a decoded excitation signal is maintained, thereby ensuring auditory quality of a restored bandwidth extension frequency band signal and enhancing auditory quality of an output audio signal.

BRIEF DESCRIPTION OF DRAWINGS

To describe the technical solutions in the embodiments of the present invention or in the prior art more clearly, the following briefly introduces the accompanying drawings required for describing the embodiments or the prior art. The accompanying drawings in the following description show some embodiments of the present invention, and a person of ordinary skill in the art may still derive other drawings from these accompanying drawings without creative efforts.

DESCRIPTION OF EMBODIMENTS

To make the objectives, technical solutions, and advantages of the embodiments of the present invention clearer, the following clearly and completely describes the technical solutions in the embodiments of the present invention with reference to the accompanying drawings in the embodiments of the present invention. The described embodiments are some but not all of the embodiments of the present invention. All other embodiments obtained by a person of ordinary skill in the art based on the embodiments of the present invention without creative efforts shall fall within the protection scope of the present invention.

In the field of digital signal processing, an audio coder-decoder (codec) and a video codec are widely applied to various electronic devices such as a mobile phone, a wireless apparatus, a personal data assistant (PDA), a handheld or portable computer, a global positioning system (GPS) receiver/navigator, a camera, an audio/video player, a camcorder, a videorecorder, and a monitoring device. Generally, this type of electronic device includes an audio coder or an audio decoder, where the audio coder or decoder may be directly implemented by a digital circuit or a chip such as a digital signal processor (DSP), or be implemented by driving, by software code, a processor to execute a process in the software code.

For example, an audio encoder first performs framing processing on an input signal to obtain time domain data with one frame being 20 milliseconds (ms), then performs windowing processing on the time domain data to obtain a signal after windowing, performs frequency domain transformation on the time domain signal after windowing, to transform the signal from a time domain to a frequency domain, encodes the frequency domain signal, and transmits the encoded frequency domain signal to a decoder side. After receiving a compressed bitstream transmitted by an encoder side, the decoder side performs a corresponding decoding operation on the signal, performs, on a frequency domain signal obtained by decoding inverse transformation corresponding to the transformation used by the encoding end, to transform the signal from frequency domain to time domain, and performs post processing on the time domain signal to obtain a synthesized signal, that is, a signal output by the decoder side.

Figure 1:
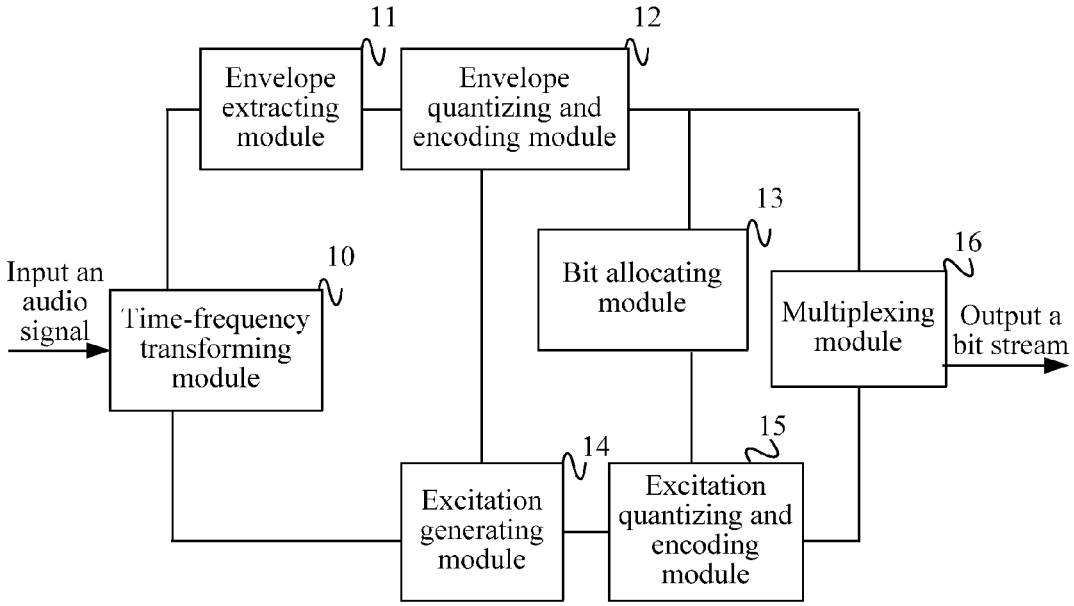
FIG. 1 is a schematic structural diagram of an encoding device in the prior art.

FIG. 1 is a schematic structural diagram of an encoding device in the prior art. As shown in FIG. 1, the prior-art encoding device includes a time-frequency transforming module 10, an envelope extracting module 11, an envelope quantizing and encoding module 12, a bit allocating module 13, an excitation generating module 14, an excitation quantizing and encoding module 15, and a multiplexing module 16.

As shown in FIG. 1, the time-frequency transforming module 10 is configured to receive an input audio signal and then transform the audio signal from a time domain signal to a frequency domain signal. Then, the envelope extracting module 11 extracts a frequency envelope from the frequency domain signal obtained by a transform by the time-frequency transforming module 10, where the frequency envelope may also be referred to as a sub-band normalization factor. Herein, the frequency envelope includes a frequency envelope of a low frequency band signal and a frequency envelope of a high frequency band signal in the frequency domain signal. The envelope quantizing and encoding module 12 performs quantization and encoding processing on the frequency envelope obtained by the envelope extracting module 11 to obtain a quantized and encoded frequency envelope. The bit allocating module 13 determines a bit allocation of each sub-band according to the quantized frequency envelope. The excitation generating module 14 performs, using information about the quantized and encoded envelope obtained by the envelope quantizing and encoding module 12, normalization processing on the frequency domain signal obtained by the time-frequency transforming module 10, to obtain an excitation signal, that is, a normalized frequency domain signal, and the excitation signal also includes an excitation signal of the high frequency band signal and an excitation signal of the low frequency band signal. The excitation quantizing and encoding module 15 performs, according to the bit allocation of each sub-band allocated by the bit allocating module 13, quantization and encoding processing on the excitation signal generated by the excitation generating module 14 to obtain a quantized excitation signal. The multiplexing module 16 separately multiplexes the quantized frequency envelope quantized by the envelope quantizing and encoding module 12 and the quantized excitation signal quantized by the excitation quantizing and encoding module 15 into a bitstream, and outputs the bitstream to a decoding device.

Figure 2:
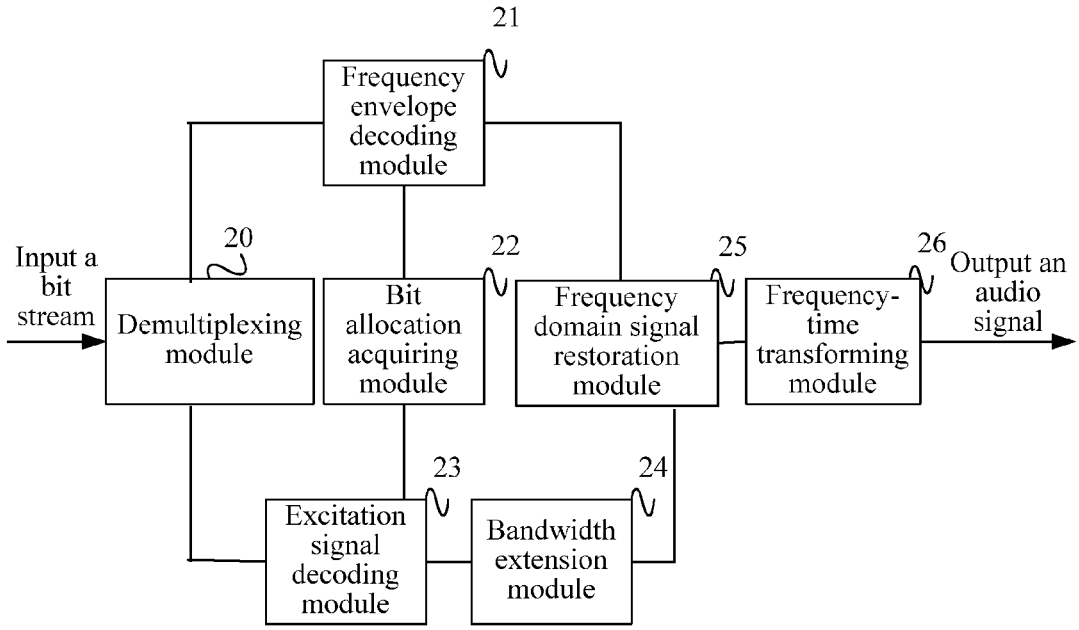
FIG. 2 is a schematic structural diagram of a decoding device in the prior art.

FIG. 2 is a schematic structural diagram of a decoding device in the prior art. As shown in FIG. 2, the existing decoding device includes a demultiplexing module 20, a frequency envelope decoding module 21, a bit allocation acquiring module 22, an excitation signal decoding module 23, a bandwidth extension module 24, a frequency domain signal restoration module 25, and a frequency-time transforming module 26.

As shown in FIG. 2, the demultiplexing module 20 receives a bitstream sent by a side of an encoding device, and demultiplexes (including decoding) the bitstream to separately obtain a quantized frequency envelope and a quantized excitation signal. The frequency envelope decoding module 21 acquires the quantized frequency envelope from a signal obtained by demultiplexing by the demultiplexing module 20, and perform quantization and decoding to obtain a frequency envelope. The bit allocation acquiring module 22 determines a bit allocation of each sub-band according to the frequency envelope obtained by the frequency envelope decoding module 21. The excitation signal decoding module 23 acquires the quantized excitation signal from the signal obtained by demultiplexing by the demultiplexing module 20, and performs, according to the bit allocation that is of each sub-band and is obtained by the bit allocation acquiring module 22, quantization and decoding to obtain an excitation signal. The bandwidth extension module 24 performs extension on an entire bandwidth according to the excitation signal obtained by the excitation signal decoding module 23. An excitation signal of a high frequency band signal is extended by using an excitation signal of a low frequency band signal. When quantizing and encoding an excitation signal and an envelope signal, an excitation quantizing and encoding module 15 and an envelope quantizing and encoding module 12 use most bits to quantize a signal of the relatively important low frequency band signal, and use few bits to quantize a signal of the high frequency band signal, and the excitation signal of the high frequency band signal may even be excluded. Therefore, the bandwidth extension module 24 needs to use the excitation signal of the low frequency band signal to extend the excitation signal of the high frequency band signal, thereby obtaining an excitation signal of an entire frequency band. The frequency domain signal restoration module 25 is separately connected to the frequency envelope decoding module 21 and the bandwidth extension module 24, and the frequency domain signal restoration module 25 restores a frequency domain signal according to the frequency envelope obtained by the frequency envelope decoding module 21 and the excitation signal that is of the entire frequency band and is obtained by the bandwidth extension module 24. The frequency-time transforming module 26 transforms the frequency domain signal restored by the frequency domain signal restoration module 25 into a time domain signal, thereby obtaining an originally input audio signal.

FIG. 1 and FIG. 2 are structural diagrams of an encoding device and a corresponding decoding device in the prior art. According to processing processes of the encoding device and the decoding device in the prior art shown in FIG. 1 and FIG. 2, it may be learned that in the prior art, an excitation signal and envelope information that are of a low frequency band signal and are used when the decoding device restores a frequency domain signal of the low frequency band signal are sent by a side of the encoding device. Therefore, restoration of the frequency domain signal of the low frequency band signal is relatively accurate. To obtain a frequency domain signal of a high frequency band signal, there is a need to first use the excitation signal of the low frequency band signal to predict an excitation signal of the high frequency band signal, and then use envelope information that is of the high frequency band signal and is sent by the side of the encoding device, to modify the predicted excitation signal of the high frequency band signal. When predicting the frequency domain signal of the high frequency band signal, the encoding device does not consider a signal type and uses a same frequency envelope. For example, when the signal type is a harmonic signal, a sub-band range covered by the used frequency envelope is relatively narrow (less than a sub-band range covered from a crest to a valley of one harmonic). When the frequency envelope is used to modify the predicted excitation signal of the high frequency band signal, more noises are brought in, therefore a relatively large error exists between the high frequency band signal obtained by modification and an actual high frequency band signal, severely affecting an accuracy rate of predicting the high frequency band signal, and reducing quality of the predicted high frequency band signal and reducing auditory quality of an audio signal. In addition, by using the foregoing prior art in which an excitation signal of a high frequency band signal is predicted according to an excitation signal of a low frequency band signal, excitation signals of different low frequency band signals may be copied into a same high frequency band signal of different frames, causing discontinuity of excitation signal, reducing quality of the predicted high frequency band signal, and thereby reducing auditory quality of an audio signal. Therefore, the following technical solutions of embodiments of the present invention may be used to resolve the foregoing technical problem.

Figure 3:
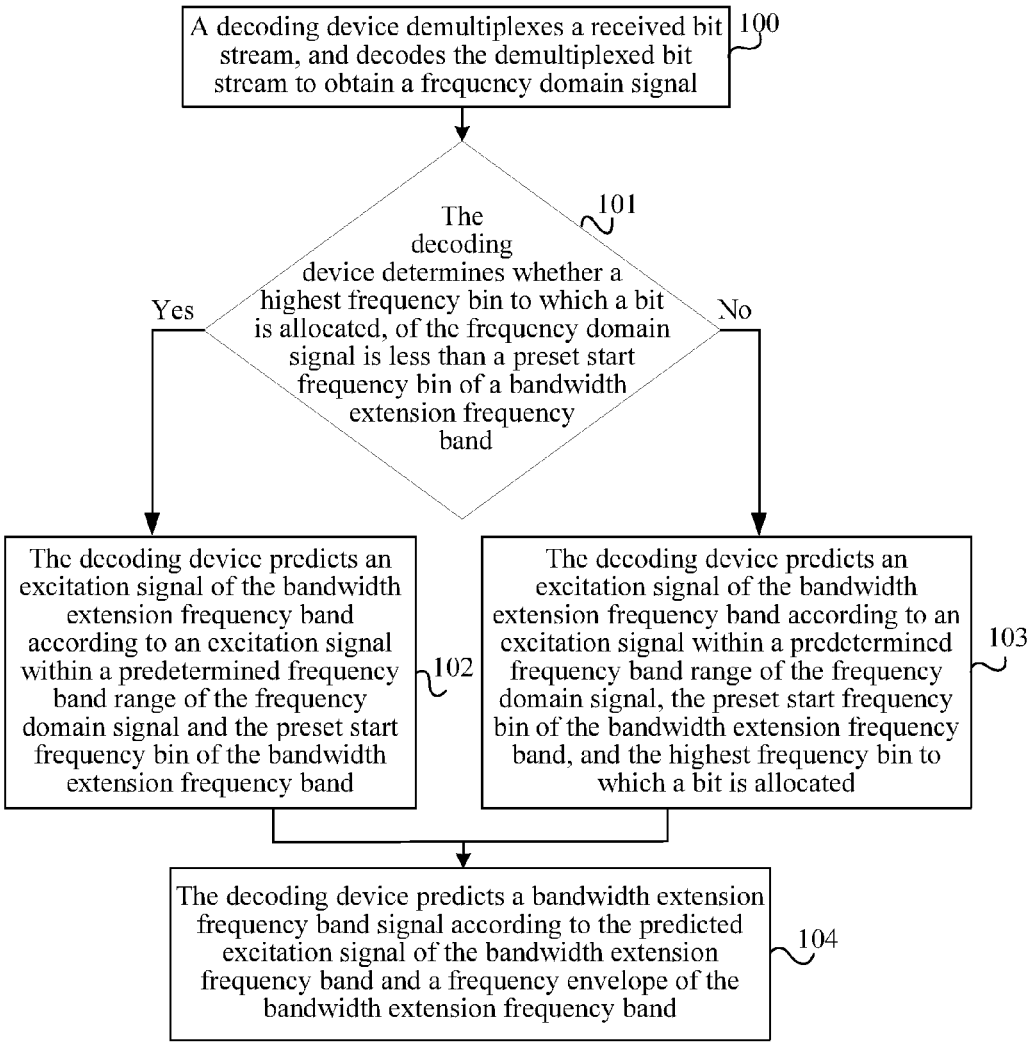
FIG. 3 is a flowchart of a method for predicting a bandwidth extension frequency band signal according to an embodiment of the present invention.

FIG. 3 is a flowchart of a method for predicting a bandwidth extension frequency band signal according to an embodiment of the present invention. In this embodiment, the method for predicting a bandwidth extension frequency band signal may be executed by a decoding device. As shown in FIG. 3, in this embodiment, the method for predicting a bandwidth extension frequency band signal may include the following steps.

100. The decoding device demultiplexes a received bitstream and decodes the demultiplexed bitstream to obtain a frequency domain signal.

101. The decoding device determines whether a highest frequency bin, to which a bit is allocated, of the frequency domain signal is less than a preset start frequency bin of a bandwidth extension frequency band; when the highest frequency bin to which a bit is allocated is less than the preset start frequency bin of the bandwidth extension frequency band, execute step 102; otherwise, when the highest frequency bin to which a bit is allocated is greater than or equal to the preset start frequency bin of the bandwidth extension frequency band, execute step 103.

102. The decoding device predicts an excitation signal of the bandwidth extension frequency band according to an excitation signal within a predetermined frequency band range of the frequency domain signal and the preset start frequency bin of the bandwidth extension frequency band, and executes step 104.

103. The decoding device predicts the excitation signal of the bandwidth extension frequency band according to the excitation signal within the predetermined frequency band range of the frequency domain signal, the preset start frequency bin of the bandwidth extension frequency band, and the highest frequency bin to which a bit is allocated, and executes step 104.

104. The decoding device predicts the bandwidth extension frequency band signal according to the predicted excitation signal of the bandwidth extension frequency band and a frequency envelope of the bandwidth extension frequency band.

According to the method for predicting a bandwidth extension frequency band signal in this embodiment, a start frequency bin of bandwidth extension is set, and a highest frequency bin to which a frequency domain signal is decoded and the start frequency bin are compared, to perform excitation restoration of a bandwidth extension frequency band, so that extended excitation signals are continuous between frames, and a frequency bin of a decoded excitation signal is maintained, thereby ensuring auditory quality of a restored bandwidth extension frequency band signal and enhancing auditory quality of an output audio signal.

Optionally, on the basis of the technical solutions of the foregoing embodiment, the following extension technical solutions may also be included to form an extended embodiment of the embodiment shown in FIG. 3. In this extended embodiment, before step 100, the method may further include the following. (a) The decoding device receives a bitstream sent by an encoding device, where the bitstream carries a quantization parameter of a low frequency band signal and a frequency envelope of the bandwidth extension frequency band signal. In this embodiment, the quantization parameter of the low frequency band signal is used to uniquely identify the low frequency band signal. (b) The decoding device acquires an excitation signal of the low frequency band signal according to the quantization parameter of the low frequency band signal.

For a specific process of acquiring the excitation signal of the low frequency band signal by the decoding device according to the quantization parameter of the low frequency band signal, refer to the prior art. For example, when the quantization parameter of the low frequency band signal is the excitation signal of the low frequency band signal and a frequency envelope of the low frequency band signal, the decoding device acquiring an excitation signal of the low frequency band signal according to the quantization parameter of the low frequency band signal may be as follows. The decoding device first restores the low frequency band signal (herein, the low frequency band signal is a frequency domain signal) according to the excitation signal of the low frequency band signal and the frequency envelope of the low frequency band signal, and then performs self-adaptive normalization processing on the low frequency band signal, to obtain the excitation signal of the low frequency band signal. When using the excitation signal that is of the low frequency band signal and in the quantization parameter to predict the excitation signal of the bandwidth extension frequency band can meet an energy requirement of a high frequency band signal, the excitation signal that is of the low frequency band signal and in the quantization parameter may be directly used to predict the excitation signal of the bandwidth extension frequency band.

The foregoing manner of self-adaptive normalization processing may use the following several manners. (1) The decoding device restores the low frequency band signal by using the decoded quantization parameter of the low frequency band signal (such as the excitation signal of the low frequency band signal and the frequency envelope of the low frequency band signal), a moving window is set in a frequency domain coefficient, an average value of frequency domain coefficient amplitudes in each moving window is calculated, where a quantity of calculated average values is the same as a quantity of frequency domain coefficients of the low frequency band signal, and the low frequency band signal (the frequency domain signal) is divided by a corresponding average value of frequency domain coefficient amplitudes, to obtain the excitation signal of the low frequency band signal. For example, the low frequency band signal has N1 frequency domain coefficients. An average value of the first frequency domain coefficient to the tenth frequency domain coefficient is calculated, an average value of the second frequency domain coefficient to the eleventh frequency domain coefficient is calculated, and an average value of the third frequency domain coefficient to the twelfth frequency domain coefficient is calculated. By analogy, N1 average values are calculated. Then, N1 low frequency band signals (frequency domain signals) are divided by corresponding average values, to obtain the excitation signal of the low frequency band signal (the frequency domain signal). (2) The decoding device restores the low frequency band signal (the frequency domain signal) by decoding the quantization parameter of the low frequency band signal (such as the excitation signal of the low frequency band signal and the frequency envelope of the low frequency band signal). For a harmonic signal, an average value of N (N>1) adjacent frequency envelopes of the low frequency band signal is calculated and used as a frequency envelope of N adjacent sub-bands, and all frequency domain signals of the N adjacent sub-bands are divided by the average value, to obtain an excitation signal of the low frequency band signals of the N adjacent sub-bands. By analogy, the excitation signal of the entire low frequency band signal is calculated. For a non-harmonic signal, each sub-band of the low frequency band signal is further divided into M (M>1) small sub-bands, a frequency envelope is further calculated for each small sub-band, and a frequency domain signal of the small sub-band is divided by the calculated frequency envelope of the small sub-band, to obtain an excitation signal of the small sub-band. By analogy, the excitation signal of the entire low frequency band signal is obtained. For a detailed process of self-adaptive normalization processing, refer to records in the prior art. Details are not described herein again.

Optionally, in this extended embodiment, before step 104, the method may further include the following step. The decoding device decodes the bitstream to obtain the frequency envelope of the bandwidth extension frequency band so that step 104 can be executed.

Optionally, before step 104, the method may further include the following step. The decoding device decodes the bitstream to obtain a signal type and acquires the frequency envelope of the bandwidth extension frequency band according to the signal type.

For example, when the signal type is a non-harmonic signal, the decoding device demultiplexes the received bitstream and decodes the demultiplexed bitstream to obtain the frequency envelope of the bandwidth extension frequency band. When the signal type is a harmonic signal, the decoding device demultiplexes the received bitstream, decodes the demultiplexed bitstream to obtain an initial frequency envelope of the bandwidth extension frequency band, and uses a value that is obtained by performing weighting calculation on the initial frequency envelope and N adjacent initial frequency envelopes as the frequency envelope of the bandwidth extension frequency band, where N is greater than or equal to 1.

Using the method for predicting a bandwidth extension frequency band signal in the foregoing embodiment, continuity of predicted excitation signals that are of a bandwidth extension frequency band signal and between a former frame and a latter frame can be effectively ensured, thereby ensuring auditory quality of a restored bandwidth extension frequency band signal and enhancing auditory quality of an audio signal.

Figure 4:
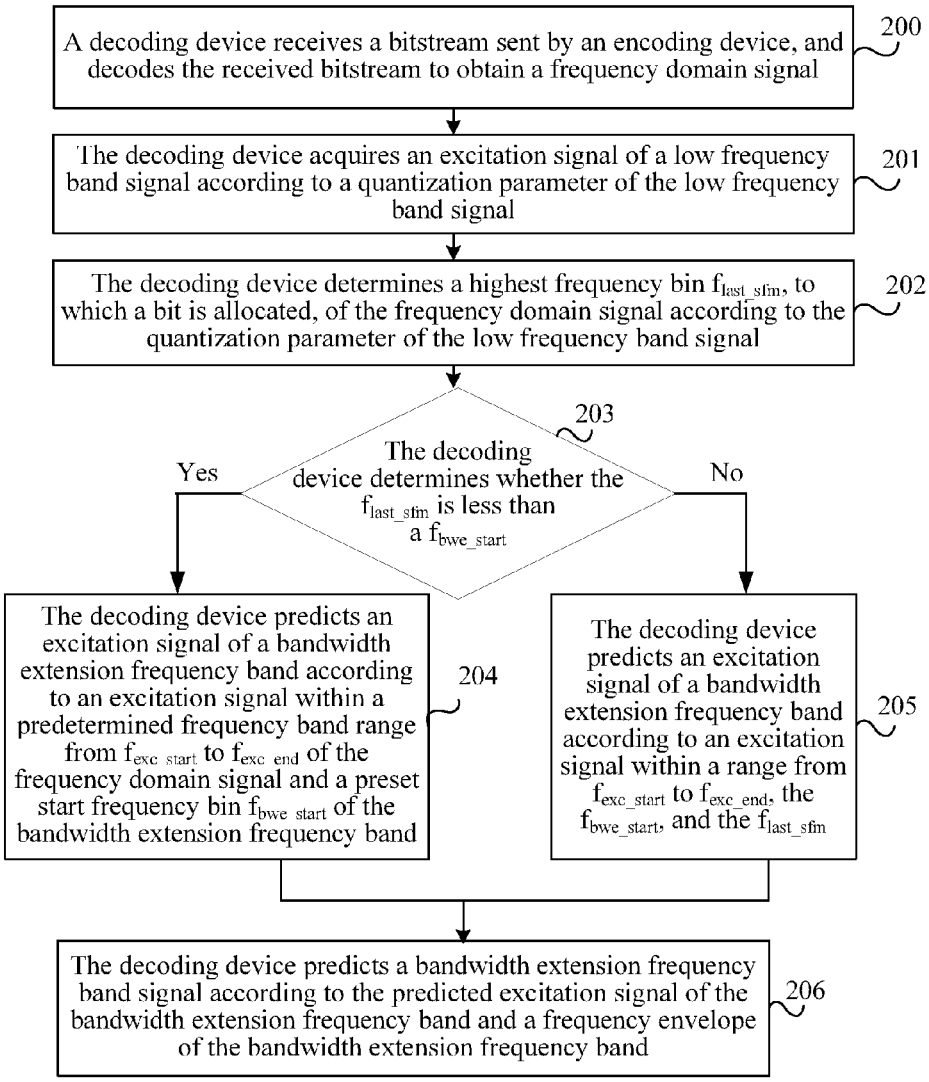
FIG. 4 is a flowchart of a method for predicting a bandwidth extension frequency band signal according to another embodiment of the present invention.

FIG. 4 is a flowchart of a method for predicting a bandwidth extension frequency band signal according to another embodiment of the present invention. On the basis of the embodiment shown in FIG. 3, in this embodiment, the technical solutions of the present invention are introduced in more details in the method for predicting a bandwidth extension frequency band signal. In this embodiment, the method for predicting a bandwidth extension frequency band signal may include the following content.

200. A decoding device receives a bitstream sent by an encoding device and decodes the received bitstream to obtain a frequency domain signal.

The bitstream carries a quantization parameter of a low frequency band signal and a frequency envelope of the bandwidth extension frequency band signal.

201. The decoding device acquires an excitation signal of the low frequency band signal according to the quantization parameter of the low frequency band signal.

202. The decoding device determines a highest frequency $f_{last_sfm}$, on which a bit is allocated, of the frequency domain signal according to the quantization parameter of the low frequency band signal.

In this embodiment, the $f_{last_sfm}$ is used to represent the highest frequency bin, to which a bit is allocated, of the frequency domain signal.

203. The decoding device determines whether the $f_{last_sfm}$ is less than a preset start frequency $f_{bwe_start}$ of a bandwidth extension frequency band of the frequency domain signal; when the $f_{last_sfm}$ is less than the $f_{bwe_start}$, execute step 204; otherwise, and when the $f_{last_sfm}$ is greater than or equal to the $f_{bwe_start}$, execute step 205.

Figure 5A:
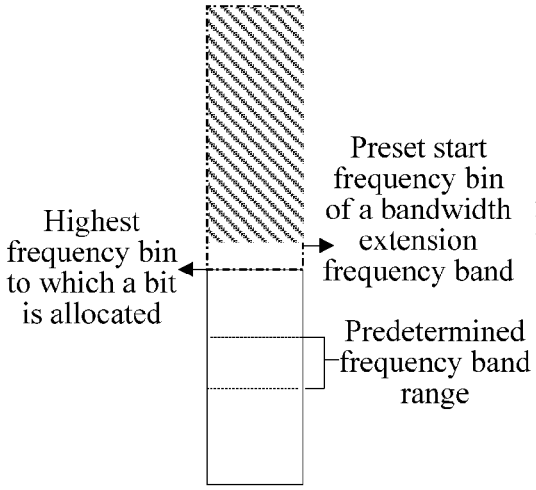
FIG. 5A and FIG. 5B are schematic diagrams of a frequency band according to an embodiment of the present invention.
Figure 5B:
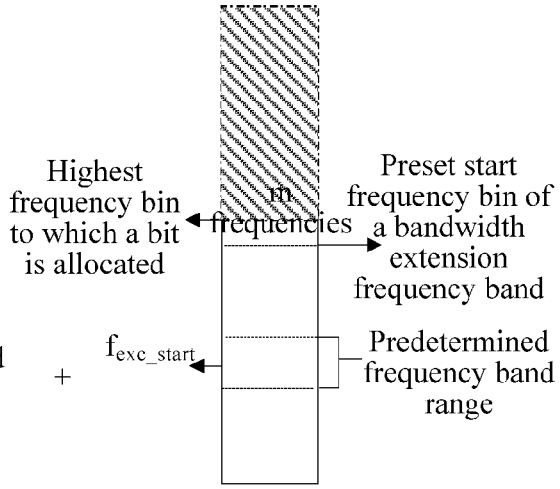

Referring to schematic diagrams of frequency bins in a frequency band in FIG. 5A and FIG. 5B, a frequency domain signal to which a bit is allocated may be directly obtained by decoding; however, an excitation signal of a bandwidth extension frequency band needs to be obtained by prediction according to a decoded frequency domain signal, that is, an excitation signal within a predetermined frequency band range of the frequency domain signal is selected to predict the excitation signal of the bandwidth extension frequency band. When a size relationship between the $f_{last_sfm}$ and the $f_{bwe_start}$ is different, a start frequency of extension and a signal extension range are different. A shaded part shown in the figures represents a frequency band range, within which an excitation signal needs to be copied from a low frequency band, of the bandwidth extension frequency band, a shaded part in FIG. 5A is from the preset start frequency bin of the bandwidth extension frequency band to a highest frequency bin of the bandwidth extension frequency band, and a shaded part in FIG. 5B is from the highest frequency bin to which a bit is allocated to the highest frequency bin of the bandwidth extension frequency band. In the case of FIG. 5A, the copied excitation signal includes n copies of the excitation signal within the predetermined frequency band range of the frequency domain signal. In the case of FIG. 5B, the copied excitation signal includes an excitation signal from $f_{exc_start}$+ of the predetermined frequency band range to an end frequency $f_{exc_end}$ of the predetermined frequency band range and the n copies of the excitation signal within the predetermined frequency band range, where n is an integer or a non-integer greater than 0.

In this embodiment, the $f_{bwe_start}$ is used to represent the preset start frequency bin of the bandwidth extension frequency band of the frequency domain signal. Selection of the $f_{bwe_start}$ is related to an encoding rate (that is, the sum of bits). A higher encoding rate indicates a higher preset start frequency $f_{bwe_start}$ that is of the bandwidth extension frequency band and can be selected. For example, for an ultra-wideband signal, when the encoding rate is 24 kilobits per second (kbps), the preset start frequency $f_{bwe_start}$ of the bandwidth extension frequency band of the frequency domain signal is equal to 6.4 kilohertz (kHz); when the encoding rate is 32 kbps, the preset start frequency $f_{bwe_start}$ that is of the bandwidth extension frequency band and of the frequency domain signal is equal to 8 kHz.

Returning to FIG. 4, 204. The decoding device predicts an excitation signal of the bandwidth extension frequency band according to an excitation signal within a predetermined frequency band range from $f_{exc_start}$ to $f_{exc_end}$ of the frequency domain signal and the preset start frequency $f_{bwe_start}$ of the bandwidth extension frequency band, and executes step 206.

In this embodiment, the predetermined frequency band range of the frequency domain signal is a predetermined frequency band range that is from the $f_{exc_start}$ to the $f_{exc_end}$ and in the low frequency band signal, the $f_{exc_start}$ is a preset start frequency bin of the bandwidth extension frequency band that is of the frequency domain signal and in the low frequency band signal, and the $f_{exc_end}$ is a preset end frequency bin of the bandwidth extension frequency band that is of the frequency domain signal and in the low frequency band signal, where the $f_{exc_end}$ is greater than the $f_{exc_start}$.

For example, the decoding device may make n copies of the excitation signal within the predetermined frequency band range from the $f_{exc_start}$ to the $f_{exc_end}$ of the frequency domain signal, and use the n copies of the excitation signal as an excitation signal between the preset start frequency $f_{bwe_start}$ of the bandwidth extension frequency band and the highest frequency ftop_sfm of the bandwidth extension frequency band, where n is an integer or a non-integer greater than 0, and n is equal to a ratio of a quantity of frequency bins between the preset start frequency $f_{bwe_start}$ of the bandwidth extension frequency band and the highest frequency $f_{top_sfm}$ of the bandwidth extension frequency band to a quantity of frequency bins within the predetermined frequency band range from the $f_{exc_start}$ to the $f_{exc_end}$ of the frequency domain signal.

For example, in an implementation, when the prediction is started from the preset start frequency $f_{bwe_start}$ of the bandwidth extension frequency band, the decoding device may make n copies of the excitation signal within the predetermined frequency band range from the $f_{exc_start}$ to the $f_{exc_end}$ of the frequency domain signal, and use the n copies of the excitation signal as a bandwidth extension frequency band signal between the preset start frequency $f_{bwe_start}$ of the bandwidth extension frequency band and the highest frequency $f_{top_sfm}$ of the bandwidth extension frequency band. In this embodiment, n may be a positive integer or a decimal, and n is equal to the ratio of the quantity of frequency bins between the preset start frequency $f_{bwe_start}$ of the bandwidth extension frequency band and the highest frequency $f_{top_sfm}$ of the bandwidth extension frequency band to the quantity of frequency bins within the predetermined frequency band range from the $f_{exc_start}$ to the $f_{exc_end}$ of the frequency domain signal. Selection of the predetermined frequency band range from the $f_{exc_start}$ to the $f_{exc_end}$ of the frequency domain signal is related to a signal type and an encoding rate. For example, in the case of a relatively low rate, for a harmonic signal, a relatively low frequency band signal with relatively better encoding in low frequency band signals is selected, and for a non-harmonic signal, a relatively high frequency band signal with relatively poorer encoding in the low frequency band signals is selected; in the case of a relatively high rate, for a harmonic signal, a relatively high frequency band in the low frequency band signals may be selected.

The highest frequency bin of the bandwidth extension frequency band refers to a highest frequency, at which a signal needs to be output, of a frequency band or a specified frequency. For example, a wideband signal may be 7 kHz or 8 kHz, and an ultra-wideband signal may be 14 kHz or 16 kHz or another preset specific frequency.

In this embodiment, that when the prediction is started from the preset start frequency $f_{bwe_start}$ of the bandwidth extension frequency band, the decoding device makes n copies of the excitation signal within the predetermined frequency band range from the $f_{exc_start}$ to the $f_{exc_end}$ of the frequency domain signal, and uses the n copies of the excitation signal as the bandwidth extension frequency band signal between the preset start frequency $f_{bwe_start}$ of the bandwidth extension frequency band and the highest frequency $f_{top_sfm}$ of the bandwidth extension frequency band may be implemented in the following manner. When the prediction is started from the preset start frequency $f_{bwe_start}$ of the bandwidth extension frequency band, the decoding device sequentially makes integer copies in the n copies of the excitation signal within the predetermined frequency band range from the $f_{exc_start}$ to the $f_{exc_end}$ of the frequency domain signal and non-integer copies in the n copies of the excitation signal within the predetermined frequency band range from the $f_{exc_start}$ to the $f_{exc_end}$ of the frequency domain signal, and uses the two parts of excitation signals as an excitation signal of the bandwidth extension frequency band between the preset start frequency $f_{bwe_start}$ of the bandwidth extension frequency band and the highest frequency $f_{top_sfm}$ of the bandwidth extension frequency band, where the non-integer part of n is less than 1.

In this embodiment, the n copies of the excitation signal within the predetermined frequency band range from the $f_{exc_start}$ to the $f_{exc_end}$ of the frequency domain signal may be made in sequence, that is, one copy of the excitation signal within the predetermined frequency band range from the $f_{exc_start}$ to the $f_{exc_end}$ of the frequency domain signal is made each time until the n copies of the excitation signal within the predetermined frequency band range from the $f_{exc_start}$ to the $f_{exc_end}$ of the frequency domain signal are made; or a mirror copy (or referred to as a fold copy) may also be made, that is, when the integer copies in the n copies of the excitation signal within the predetermined frequency band range from the $f_{exc_start}$ to the $f_{exc_end}$ of the frequency domain signal are made, a forward copy (that is, from the fexc_start to the $f_{exc_end}$) and a backward copy (that is, from the $f_{exc_end}$ to the $f_{exc_start}$) are alternately made in sequence until n copies are complete.

Alternatively, when the prediction is started from the preset highest frequency $f_{top_sfm}$ of the bandwidth extension frequency band, the decoding device may make n copies of the excitation signal within the predetermined frequency band range from the $f_{exc_start}$ to the $f_{exc_end}$ of the frequency domain signal, and use the n copies of the excitation signal as a high frequency excitation signal between the preset start frequency $f_{bwe_start}$ of the bandwidth extension frequency band and the highest frequency $f_{top_sfm}$ of the bandwidth extension frequency band, which may be implemented in the following manner. When the prediction is started from the highest frequency $f_{top_sfm}$ of the bandwidth extension frequency band, the decoding device sequentially makes non-integer copies in the n copies of the low frequency excitation signal within the frequency band range from the fexc_start to the $f_{exc_end}$ and integer copies in the n copies of the excitation signal within the predetermined frequency band range from the $f_{exc_start}$ to the $f_{exc_end}$ of the frequency domain signal, and uses the two parts of excitation signals as the excitation signal of the bandwidth extension frequency band between the preset start frequency $f_{bwe_start}$ of the bandwidth extension frequency band and the highest frequency $f_{top_sfm}$ of the bandwidth extension frequency band, where the non-integer part of n is less than 1.

When the prediction is started from the highest frequency $f_{top_sfm}$ of the bandwidth extension frequency band, making n copies of the excitation signal within the predetermined frequency band range from the $f_{exc_start}$ to the $f_{exc_end}$ of the frequency domain signal belongs to copying by block. For example, the highest frequency bin of the bandwidth extension frequency band is 14 kHz, and the $f_{exc_start}$ to the $f_{exc_end}$ is 1.6 kHz to 4 kHz. When 0.5 copies of a low frequency excitation signal from the $f_{exc_start}$ to the $f_{exc_end}$, that is, from 1.6 kHz to 2.8 kHz are made. Using the solution of this step, the excitation signal in the low frequency band from 1.6 kHz to 2.8 kHz may be copied into a bandwidth extension frequency band between (14-1.2) kHz and 14 kHz and used as an excitation signal of this bandwidth extension frequency band. In this case, 1.6 kHz is accordingly copied into (14-1.2) kHz, and 2.8 kHz is accordingly copied into 14 kHz.

In the foregoing two manners, regardless of whether to predict the excitation signal of the bandwidth extension frequency band between the start frequency $f_{bwe_start}$ of the bandwidth extension frequency band and the highest frequency $f_{top_sfm}$ of the bandwidth extension frequency band starting from the preset start frequency $f_{bwe_start}$ of the bandwidth extension frequency band or starting from the highest frequency $f_{top_sfm}$ of the bandwidth extension frequency band, results of the excitation signal that is finally obtained by prediction and is of the bandwidth extension frequency band between the preset start frequency $f_{bwe_start}$ of the bandwidth extension frequency band and the highest frequency $f_{top_sfm}$ of the bandwidth extension frequency band are the same.

In an implementation process of the foregoing solution, a quotient and a remainder may first be calculated and acquired by dividing a frequency bandwidth between the preset start frequency $f_{bwe_start}$ of the bandwidth extension frequency band and a highest frequency $f_{top_sfm}$ of a frequency band signal by a frequency bandwidth between the $f_{exc_start}$ and the $f_{exc_end}$. Herein, the quotient is the integer part of n, and the remainder/($f_{exc_end}-f_{exc_start}$) is the non-integer part of n. The integer part of n and the non-integer part of n may first be calculated in this manner, and then, the excitation signal of the bandwidth extension frequency band between the preset start frequency $f_{bwe_start}$ of the bandwidth extension frequency band and the highest frequency $f_{top_sfm}$ of the bandwidth extension frequency band is predicted in the foregoing manner.

205. The decoding device predicts the excitation signal of the bandwidth extension frequency band according to the excitation signal within a range from the $f_{exc_start}$ to the $f_{exc_end}$, the $f_{bwe_start}$, and the $f_{last_sfm}$, and executes step 206.

For example, the decoding device may make a copy of an excitation signal from the $m^{th}$ frequency bin above the start frequency bin $f_{exc_start}$ of the predetermined frequency band range of the frequency domain signal to the end frequency bin $f_{exc_end}$ of the predetermined frequency band range of the frequency domain signal and n copies of the excitation signal within the predetermined frequency band range of the frequency domain signal, and use the two parts of excitation signals as an excitation signal between the highest frequency $f_{last_sfm}$, on which a bit is allocated, of the frequency domain signal and the highest frequency $f_{top_sfm}$ of the bandwidth extension frequency band, where n is 0 or an integer or a non-integer greater than 0, and m is a value of a quantity of frequency bins between the highest frequency $f_{last_sfm}$ on which a bit is allocated and the preset start frequency $f_{bwe_start}$ of the bandwidth extension frequency band.

For example, when the prediction is started from the highest frequency $f_{last_sfm}$ on which a bit is allocated, the decoding device may sequentially make a copy of the excitation signal from ($f_{exc_start}+(f_{last_sfm}-f_{bwe_start})$) to the $f_{exc_end}$ within the predetermined frequency band range of the frequency domain signal and n copies of the excitation signal within an excitation frequency band range from the $f_{exc_start}$ to the $f_{exc_end}$, and use the two parts of excitation signals as the excitation signal of the bandwidth extension frequency band between the highest frequency $f_{last_sfm}$ on which a bit is allocated and the highest frequency $f_{top_sfm}$ of the bandwidth extension frequency band, where n is 0 or an integer or a non-integer greater than 0.

In an implementation, when the prediction is started from the highest frequency $f_{last_sfm}$ on which a bit is allocated, the decoding device may sequentially make a copy of the excitation signal from the ($f_{exc_start}+(f_{last_sfm}-f_{bwe_start})$) to the $f_{exc_end}$ within the predetermined frequency band range of the frequency domain signal, the excitation signal within the predetermined frequency band range from the $f_{exc_start}$ to the $f_{exc_end}$ of the frequency domain signal, and non-integer copies in the n copies of the excitation signal within the predetermined frequency band range from the $f_{exc_start}$ to the $f_{exc_end}$ of the frequency domain signal, and use the three parts of excitation signals as the excitation signal of the bandwidth extension frequency band between the highest frequency $f_{last_sfm}$ on which a bit is allocated and the highest frequency $f_{top_sfm}$ of the bandwidth extension frequency band, where the non-integer part of n is less than 1.

Alternatively, when the prediction is started from the highest frequency $f_{top_sfm}$ of the bandwidth extension frequency band, the decoding device may sequentially make n copies of the excitation signal within the predetermined frequency band range from the $f_{exc_start}$ to the $f_{exc_end}$ of the frequency domain signal and a copy of the excitation signal from ($f_{exc_start}+(f_{last_sfm}-f_{bwe_start})$) to the $f_{exc_end}$ within the predetermined frequency band range of the frequency domain signal, and use the two parts of excitation signals as the excitation signal of the bandwidth extension frequency band between the highest frequency $f_{last_sfm}$ on which a bit is allocated and the highest frequency $f_{top_sfm}$ of the bandwidth extension frequency band, where similarly, n is 0 or an integer or a non-integer greater than 0.

In an implementation, when the prediction is started from the highest frequency $f_{top_sfm}$ of the bandwidth extension frequency band, the decoding device may sequentially make non-integer copies in the n copies of the excitation signal within the predetermined frequency band range from the $f_{exc_start}$ to the $f_{exc_end}$ of the frequency domain signal, integer copies in the n copies of the excitation signal within the predetermined frequency band range from the $f_{exc_start}$ to the $f_{exc_end}$ of the frequency domain signal, and a copy of the excitation signal from the ($f_{exc_start}+(f_{last_sfm}-f_{bwe_start})$) to the $f_{exc_end}$ within the predetermined frequency band range of the frequency domain signal, and use the three parts of excitation signals as the excitation signal of the bandwidth extension frequency band between the highest frequency $f_{last_sfm}$ on which a bit is allocated and the highest frequency bin of the bandwidth extension frequency band, where the non-integer part of n is less than 1.

When the decoding device performs prediction starting from the highest frequency $f_{top_sfm}$ of the bandwidth extension frequency band, making n copies of the excitation signal within the predetermined frequency band range from the $f_{exc_start}$ to the $f_{exc_end}$ of the frequency domain signal, also belongs to copying by block. An excitation signal corresponding to a low frequency within the predetermined frequency band range of the frequency domain signal is located on a corresponding low frequency in the bandwidth extension frequency band, and an excitation signal corresponding to a high frequency within the predetermined frequency band range of the frequency domain signal is located on a corresponding high frequency in the bandwidth extension frequency band. For details, refer to the foregoing related records. Similarly, integer copies in the n copies of the excitation signal within the predetermined frequency band range from the $f_{exc_start}$ to the $f_{exc_end}$ of the frequency domain signal may also be sequential copying or mirror copying. For details, refer to the foregoing related records. Details are not described herein again.

In the foregoing two manners, regardless of whether to predict the excitation signal of the bandwidth extension frequency band between the highest frequency $f_{last_sfm}$ on which a bit is allocated and the highest frequency bin of the bandwidth extension frequency band starting from the highest frequency $f_{last_sfm}$ on which a bit is allocated or starting from the highest frequency $f_{top_sfm}$ of the bandwidth extension frequency band, results of the excitation signal that is finally obtained by prediction and is of the bandwidth extension frequency band between the highest frequency $f_{last_sfm}$ on which a bit is allocated and the highest frequency bin of the bandwidth extension frequency band are the same.

In addition, in the foregoing solution, when a bandwidth from the $(f_{exc_start}+(f_{last_sfm}-f_{bwe_start}))$ to the $f_{exc_end}$ is greater than or equal to a bandwidth between the highest frequency $f_{last_sfm}$ on which a bit is allocated and the highest frequency bin of the bandwidth extension frequency band, there is only a need to acquire, in the bandwidth from the $(f_{exc_start}+(f_{last_sfm}-f_{bwe_start}))$ to the $f_{exc_end}$ and starting from the $(f_{exc_start}+(f_{last_sfm}-f_{bwe_start}))$, an excitation signal that is of a low frequency band signal and has a same bandwidth as that between the highest frequency $f_{last_sfm}$ on which a bit is allocated and the highest frequency bin of the bandwidth extension frequency band, and use the excitation signal as the excitation signal of the bandwidth extension frequency band between the highest frequency $f_{last_sfm}$ on which a bit is allocated and the highest frequency bin of the bandwidth extension frequency band.

In an implementation process of the foregoing solution, a quotient and a remainder may first be calculated and acquired by dividing a difference between $(f_{exc_start}+(f_{last_sfm}-f_{bwe_start}))$ and the frequency bandwidth between the highest frequency $f_{last_sfm}$ on which a bit is allocated and a highest frequency $f_{top_sfm}$ of a frequency band signal by the frequency bandwidth between the $f_{exc_start}$ and the $f_{exc_end}$. Herein, the quotient is the integer part of n, and the remainder/$(f_{exc_end}-f_{exc_start})$ is the non-integer part of n. The integer part of n and the non-integer part of n may first be calculated in this manner, and then, the excitation signal of the bandwidth extension frequency band between the highest frequency $f_{last_sfm}$ on which a bit is allocated and the highest frequency $f_{top_sfm}$ of the bandwidth extension frequency band is predicted in the foregoing manner.

For example, when the encoding rate is 24 kbps, the preset start frequency $f_{bwe_start}$ of the bandwidth extension frequency band is equal to 6.4 kHz, and the $f_{top_sfm}$ is 14 kHz. The excitation signal of the bandwidth extension frequency band is predicted in the following manner. It is assumed that a preselected extension range of a low frequency band signal is 0 kHz-4 kHz, and a highest frequency $f_{last_sfm}$, on which a bit is allocated, in the Nth frame is equal to 8 kHz; in this case, the $f_{last_sfm}$ is greater than the $f_{bwe_start}$. First, self-adaptive normalization processing is performed on a selected excitation signal that is of the low frequency band signal and within a frequency band range of 0 kHz-4 kHz (For a specific process of self-adaptive normalization processing, refer to the records in the foregoing embodiment. Details are not described herein again.), and then, an excitation signal of a bandwidth extension frequency band greater than 8 kHz is predicted from the normalized excitation signal of the low frequency band signal. According to the manner in the foregoing embodiment, a sequence for copying the selected normalized excitation signal of the low frequency band signal is as follows. First, an excitation signal from (8 kHz-6.4 kHz) to 4 kHz within a predetermined frequency band range of a frequency domain signal is copied, then, 0.9 copies of an excitation signal within the predetermined frequency band range from the $f_{exc_start}$ to the $f_{exc_end}$ (0 kHz-4 kHz) of the frequency domain signal are made, that is, an excitation signal from 0 kHz to 3.6 kHz within the predetermined frequency band range of the frequency domain signal is copied, and the two parts of excitation signals are used as the excitation signal of the bandwidth extension frequency band between the highest frequency ($f_{last_sfm}$=8 kHz) on which a bit is allocated and the highest frequency $f_{top_sfm}$ ($f_{top_sfm}$=14 kHz) of the bandwidth extension frequency band. If a highest frequency $f_{last_sfm}$, on which a bit is allocated, in the $(N+1)^{th}$ frame is less than or equal to 6.4 kHz (a preset start frequency $f_{bwe_start}$ of a bandwidth extension frequency band is equal to 6.4 kHz), self-adaptive normalization processing is performed on a selected excitation signal that is of the low frequency band signal and within the frequency band range of 0 kHz-4 kHz, and then, an excitation signal of a bandwidth extension frequency band greater than 6.4 kHz is predicted from the normalized excitation signal of the low frequency band signal. According to the manner in the foregoing embodiment, a sequence for copying the selected normalized excitation signal of the low frequency band signal is as follows. First, one copy of the excitation signal within the predetermined frequency band range from the $f_{exc_start}$ to the $f_{exc_end}$ (0 kHz-4 kHz) of the frequency domain signal is made, then 0.9 copies of the excitation signal within the predetermined frequency band range from the $f_{exc_start}$ to the $f_{exc_end}$ (0 kHz-4 kHz) of the frequency domain signal are made, and the two parts of excitation signals are used as the excitation signal of the bandwidth extension frequency band between the preset start frequency ($f_{bwe_start}$=6.4 kHz) of the bandwidth extension frequency band and the highest frequency $f_{top_}$sfm ($f_{top_sfm}$=14 kHz) of the bandwidth extension frequency band.

The highest frequency bin of the bandwidth extension frequency band is determined according to a type of the frequency domain signal. For example, when the type of the frequency domain signal is an ultra-wideband signal, the highest frequency $f_{top_sfm}$ of the bandwidth extension frequency band is 14 kHz. Before communicating with each other, generally, the encoding device and the decoding device have determined a type of a to-be-transmitted frequency domain signal; therefore, a highest frequency bin of the frequency domain signal may be considered determined.

206. The decoding device predicts the bandwidth extension frequency band signal according to the predicted excitation signal of the bandwidth extension frequency band and a frequency envelope of the bandwidth extension frequency band.

It may be found from the foregoing prediction of the excitation signal of the bandwidth extension frequency band that although start frequency bins of bandwidth extension in the $N^{th}$ frame and $(N+1)^{th}$ frame are different, an excitation signal of a same frequency band greater than 8 kHz is predicted from an excitation signal of a same frequency band of the low frequency band signal; therefore, continuity between frames can be ensured. Then, step 206 is used so as to implement accurate prediction of the bandwidth extension frequency band.

Using the technical solutions of the foregoing embodiment, continuity of predicted excitation signals that are of a bandwidth extension frequency band signal and between a former frame and a latter frame can be effectively ensured, thereby ensuring auditory quality of a restored bandwidth extension frequency band signal and enhancing auditory quality of an audio signal.

A person of ordinary skill in the art may understand that all or a part of the steps of the foregoing method embodiments may be implemented by a program instructing relevant hardware. The program may be stored in a computer readable storage medium. When the program runs, the steps of the foregoing method embodiments are performed. The foregoing storage medium includes any medium that can store program code, such as a read-only memory (ROM), a random access memory (RAM), a magnetic disk, or an optical disc.

Figure 6:
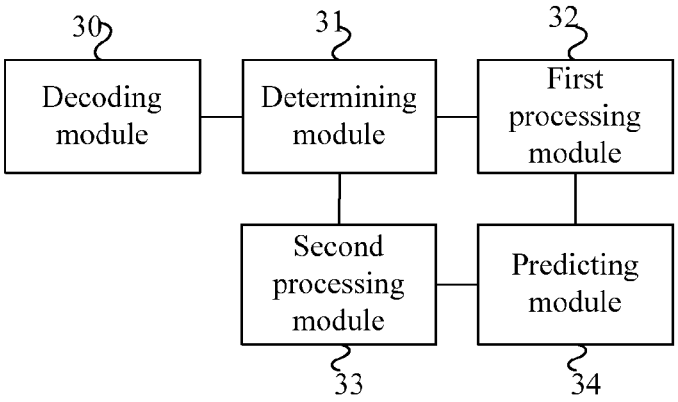
FIG. 6 is a schematic structural diagram of a decoding device according to an embodiment of the present invention.

FIG. 6 is a schematic structural diagram of a decoding device according to an embodiment of the present invention. As shown in FIG. 6, the decoding device in this embodiment includes a decoding module 30, a determining module 31, a first processing module 32, a second processing module 33, and a predicting module 34.

The decoding module 30 is configured to demultiplex a received bitstream and decode the demultiplexed bitstream to obtain a frequency domain signal. The determining module 31 is connected to the decoding module 30, and the determining module 31 is configured to determine whether a highest frequency bin, to which a bit is allocated, of the frequency domain signal obtained by decoding by the decoding module 30 is less than a preset start frequency bin of a bandwidth extension frequency band. The first processing module 32 is connected to the determining module 31, and the first processing module 32 is configured to, when the determining module 31 determines that the highest frequency bin to which a bit is allocated is less than the preset start frequency bin of the bandwidth extension frequency band, predict an excitation signal of the bandwidth extension frequency band according to an excitation signal within a predetermined frequency band range of the frequency domain signal and the preset start frequency bin of the bandwidth extension frequency band. The second processing module 33 is also connected to the determining module 31, and the second processing module 33 is configured to, when the determining module 31 determines that the highest frequency bin to which a bit is allocated is greater than or equal to the preset start frequency bin of the bandwidth extension frequency band, predict the excitation signal of the bandwidth extension frequency band according to the excitation signal within the predetermined frequency band range of the frequency domain signal, the preset start frequency bin of the bandwidth extension frequency band, and the highest frequency bin to which a bit is allocated. The predicting module 34 is connected to the first processing module 32 or the second processing module 33. When the determining module 31 determines that the highest frequency bin to which a bit is allocated is less than the preset start frequency bin of the bandwidth extension frequency band, the predicting module 34 is connected to the first processing module 32. When the determining module 31 determines that the highest frequency bin to which a bit is allocated is greater than or equal to the preset start frequency bin of the bandwidth extension frequency band, the predicting module 34 is connected to the second processing module 33. The predicting module 34 is configured to predict a bandwidth extension frequency band signal according to the excitation signal that is of the bandwidth extension frequency band and is predicted by the first processing module 32 or the second processing module 33 and a frequency envelope of the bandwidth extension frequency band.

According to the decoding device in this embodiment, an implementation process of using the foregoing modules to implement prediction of a bandwidth extension frequency band signal is the same as an implementation process in the foregoing related method embodiments. For details, refer to the records of the foregoing related method embodiments. Details are not described herein again.

According to the decoding device in this embodiment, by using the foregoing modules, a start frequency bin of bandwidth extension is set, and a highest frequency bin to which a frequency domain signal is decoded and the start frequency bin are compared to perform excitation restoration of a bandwidth extension frequency band so that extended excitation signals are continuous between frames, and a frequency bin of a decoded excitation signal is maintained, thereby ensuring auditory quality of a restored bandwidth extension frequency band signal and enhancing auditory quality of an output audio signal.

Figure 7:
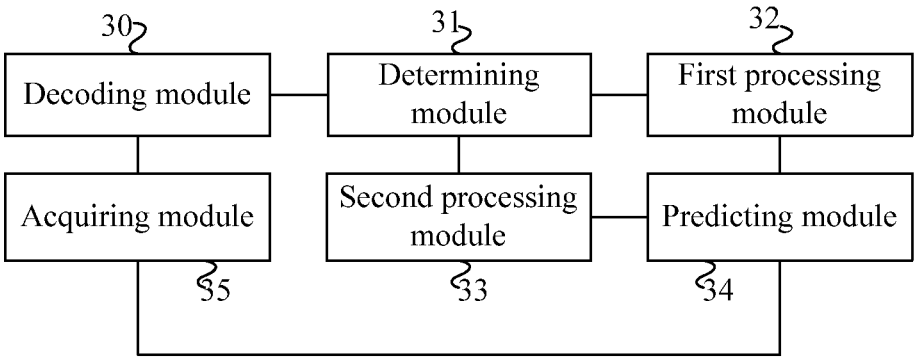
FIG. 7 is a schematic structural diagram of a decoding device according to another embodiment of the present invention.

FIG. 7 is a schematic structural diagram of a decoding device according to another embodiment of the present invention. As shown in FIG. 7, on the basis of the foregoing embodiment shown in FIG. 6, according to the decoding device in this embodiment, the technical solutions of the present invention are further introduced in more details.

As shown in FIG. 7, the first processing module 32 is configured to make n copies of the excitation signal within the predetermined frequency band range of the frequency domain signal and use the n copies of the excitation signal as an excitation signal between the preset start frequency bin of the bandwidth extension frequency band and a highest frequency bin of the bandwidth extension frequency band, where n is an integer or a non-integer greater than 0, and n is equal to a ratio of a quantity of frequency bins between the preset start frequency bin of the bandwidth extension frequency band and the highest frequency bin of the bandwidth extension frequency band to a quantity of frequency bins within the predetermined frequency band range of the frequency domain signal.

Further optionally, in this embodiment, the first processing module 32 in the decoding device is configured to, when the prediction is started from the preset start frequency bin of the bandwidth extension frequency band, sequentially make integer copies in the n copies of the excitation signal within the predetermined frequency band range of the frequency domain signal and non-integer copies in the n copies of the excitation signal within the predetermined frequency band range of the frequency domain signal, and use the two parts of excitation signals as the excitation signal between the preset start frequency bin of the bandwidth extension frequency band and the highest frequency bin of the bandwidth extension frequency band, where the non-integer part of n is less than 1; or the first processing module 32 is configured to, when the prediction is started from the highest frequency bin of the bandwidth extension frequency band, sequentially make non-integer copies in the n copies of the excitation signal within the predetermined frequency band range of the frequency domain signal and integer copies in the n copies of the excitation signal within the predetermined frequency band range of the frequency domain signal, and use the two parts of excitation signals as the excitation signal between the preset start frequency bin of the bandwidth extension frequency band and the highest frequency bin of the bandwidth extension frequency band, where the non-integer part of n is less than 1.

Optionally, in this embodiment, the second processing module 33 in the decoding device is configured to make a copy of an excitation signal from the $m^{th}$ frequency bin above a start frequency bin $f_{exc_start}$ of the predetermined frequency band range of the frequency domain signal to an end frequency bin $f_{exc_end}$ of the predetermined frequency band range of the frequency domain signal and n copies of the excitation signal within the predetermined frequency band range of the frequency domain signal, and use the two parts of excitation signals as an excitation signal between the highest frequency bin, to which a bit is allocated, of the frequency domain signal and the highest frequency bin of the bandwidth extension frequency band, where n is 0 or an integer or a non-integer greater than 0, and m is a value of a quantity of frequency bins between the highest frequency bin to which a bit is allocated and the preset start frequency bin of the bandwidth extension frequency band.

Further optionally, in this embodiment, the second processing module 33 in the decoding device is configured to, when the prediction is started from the highest frequency bin to which a bit is allocated, sequentially make a copy of an excitation signal within a frequency band range, from the $f_{exc_start}$+(the highest frequency bin to which a bit is allocated−the preset start frequency bin of the bandwidth extension frequency band) to the $f_{exc_end}$, of the frequency domain signal, integer copies in the n copies of the excitation signal within the frequency band range from the $f_{exc_start}$ to the $f_{exc_end}$ of the frequency domain signal, and non-integer copies in the n copies of the excitation signal within the frequency band range from the $f_{exc_start}$ to the $f_{exc_end}$ of the frequency domain signal, and use the three parts of excitation signals as the excitation signal between the highest frequency bin to which a bit is allocated and the highest frequency bin of the bandwidth extension frequency band, where the non-integer part of n is less than 1; or the second processing module 33 is configured to, when the prediction is started from the highest frequency bin of the bandwidth extension frequency band, sequentially make non-integer copies in the n copies of the excitation signal within the frequency band range from the $f_{exc_start}$ to the $f_{exc_end}$ of the frequency domain signal, integer copies in the n copies of the excitation signal within the frequency band range from the $f_{exc_start}$ to the $f_{exc_end}$ of the frequency domain signal, and a copy of an excitation signal within a frequency band range, from the $f_{exc_start}$+(the highest frequency bin to which a bit is allocated−the preset start frequency bin of the bandwidth extension frequency band) to the $f_{exc_end}$, of the frequency domain signal, and use the three parts of excitation signals as a high frequency excitation signal between the highest frequency bin to which a bit is allocated and the highest frequency bin of the bandwidth extension frequency band, where the non-integer part of n is less than 1.

Optionally, in this embodiment, the decoding module 30 is further configured to, before the predicting module 34 predicts the bandwidth extension frequency band signal according to the predicted excitation signal of the bandwidth extension frequency band and the frequency envelope of the bandwidth extension frequency band, decode the bitstream to obtain the frequency envelope of the bandwidth extension frequency band. In this case, the corresponding predicting module 34 is further connected to the decoding module 30, and the predicting module 34 is configured to predict the bandwidth extension frequency band signal according to the excitation signal that is of the bandwidth extension frequency band and is predicted by the first processing module 32 or the second processing module 33 and the frequency envelope that is of the bandwidth extension frequency band and is obtained by decoding by the decoding module 30.

Further optionally, in this embodiment, the decoding device further includes an acquiring module 35.

The decoding module 30 is further configured to, before the predicting module 34 predicts the bandwidth extension frequency band signal according to the predicted excitation signal of the bandwidth extension frequency band and the frequency envelope of the bandwidth extension frequency band, decode the bitstream to obtain a signal type. The acquiring module 35 is connected to the decoding module 30, and the acquiring module 35 is configured to acquire the frequency envelope of the bandwidth extension frequency band according to the signal type obtained by decoding by the decoding module 30. In this case, the corresponding predicting module 34 is connected to the acquiring module 35, and the predicting module 34 is configured to predict the bandwidth extension frequency band signal according to the excitation signal that is of the bandwidth extension frequency band and is predicted by the first processing module 32 or the second processing module 33 and the frequency envelope that is of the bandwidth extension frequency band and is obtained by the acquiring module 35.

Further optionally, the acquiring module 35 is configured to, when the signal type obtained by decoding by the decoding module 30 is a non-harmonic signal, demultiplex the received bitstream, and decode the demultiplexed bitstream to obtain the frequency envelope of the bandwidth extension frequency band; or the acquiring module 35 is configured to, when the signal type obtained by decoding by the decoding module 30 is a harmonic signal, demultiplex the received bitstream, and decode the demultiplexed bitstream to obtain an initial frequency envelope of the bandwidth extension frequency band, and use a value that is obtained by performing weighting calculation on the initial frequency envelope and N adjacent initial frequency envelopes as the frequency envelope of the bandwidth extension frequency band, where N is greater than or equal to 1.

According to the decoding device in the foregoing embodiment, the present invention is introduced using all of the foregoing optional technical solutions as examples. In an actual application, all of the foregoing optional technical solutions may be randomly combined to form an optional embodiment of the present invention in a random combination manner. Details are not described herein again.

According to the decoding device in the foregoing embodiment, an implementation process of using the foregoing modules to implement prediction of a bandwidth extension frequency band signal is the same as an implementation process in the foregoing related method embodiments. For details, refer to the records of the foregoing related method embodiments. Details are not described herein again.

According to the decoding device in the foregoing embodiment, by using the foregoing modules, a start frequency bin of bandwidth extension is set, and a highest frequency bin to which a frequency domain signal is decoded and the start frequency bin are compared, to perform excitation restoration of a bandwidth extension frequency band, so that extended excitation signals are continuous between frames, and a frequency bin of a decoded excitation signal is maintained, thereby ensuring auditory quality of a restored bandwidth extension frequency band signal and enhancing auditory quality of an output audio signal.

Functions of the decoding device shown in FIG. 2 may be adjusted according to the foregoing function modules to obtain an example diagram of the decoding device in this embodiment of the present invention. Details are not described herein again.

The decoding device in this embodiment of the present invention may be used together with the encoding device shown in FIG. 1 to form a system for predicting a bandwidth extension frequency band signal. Details are not described herein again.

Figure 8:
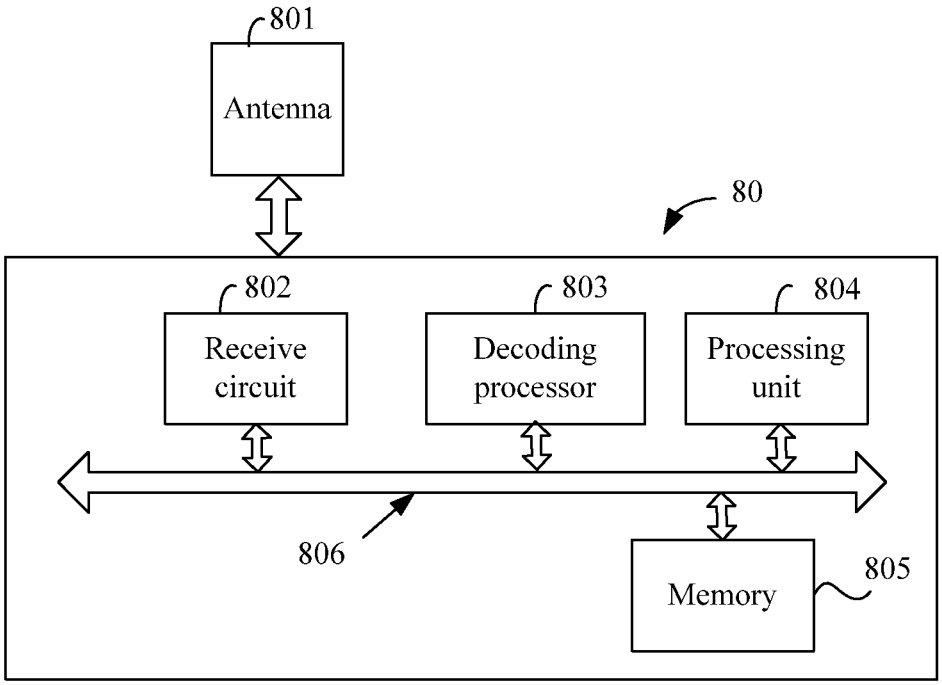
FIG. 8 is a block diagram of a decoding device according to another embodiment of the present invention.

FIG. 8 is a block diagram of a decoding device 80 according to another embodiment of the present invention. The decoding device 80 in FIG. 8 may be configured to implement steps and methods in the foregoing method embodiments. The decoding device 80 may be applied to a base station or a terminal in various communications systems. In this embodiment of FIG. 8, the decoding device 80 includes a receive circuit 802, a decoding processor 803, a processing unit 804, a memory 805, and an antenna 801. The processing unit 804 controls an operation of the decoding device 80, and the processing unit 804 may also be referred to as a central processing unit (CPU). The memory 805 may include a ROM and a RAM, and provides an instruction and data for the processing unit 804. A part of the memory 805 may further include a nonvolatile RAM (NVRAM). In a specific application, a wireless communications device such as a mobile phone may be built in the decoding device 80, or the decoding device itself may be a wireless communications device, and the decoding device 80 may further include a carrier that accommodates the receive circuit 802 so as to allow the decoding device 80 to receive data from a remote location. The receive circuit 802 may be coupled to the antenna 801. Components of the decoding device 80 are coupled together by a bus system 806, where in addition to a data bus, the bus system 806 further includes a power bus, a control bus, and a status signal bus. However, for clarity of description, various buses are marked as the bus system 806 in FIG. 8. The decoding device 80 may further include the processing unit 804 configured to process a signal, and in addition, further include the decoding processor 803.

The methods disclosed in the foregoing embodiments of the present invention may be applied to the decoding processor 803 or implemented by the decoding processor 803. The decoding processor 803 may be an integrated circuit chip and has a signal processing capability. In an implementation process, steps in the foregoing method embodiments may be completed by an integrated logic circuit of hardware in the decoding processor 803 or instructions in a form of software. These instructions may be implemented and controlled by working with the processing unit 804. The foregoing decoding processor may be a general purpose processor, a DSP, an application-specific integrated circuit (ASIC), a field programmable gate array (FPGA) or another programmable logic component, a discrete gate or a transistor logic component, or a discrete hardware component. The methods, steps, and logical block diagrams disclosed in the embodiments of the present invention may be implemented or performed. The general purpose processor may be a microprocessor, or the processor may be any conventional processor, translator, or the like. Steps of the methods disclosed with reference to the embodiments of the present invention may be directly executed and accomplished by a decoding processor embodied as hardware, or may be executed and accomplished using a combination of hardware and software modules in the decoding processor. The software module may be located in a mature storage medium in the art, such as a RAM, a flash memory, a ROM, a programmable ROM, an electrically-erasable programmable memory, or a register. The storage medium is located in the memory 805. The decoding processor 803 reads information from the memory 805, and completes the steps of the foregoing methods in combination with the hardware.

For example, the signal decoding device in FIG. 6 or FIG. 7 may be implemented by the decoding processor 803. In addition, the decoding module 30, the determining module 31, the first processing module 32, the second processing module 33, and the predicting module 34 in FIG. 6 may be implemented by the processing unit 804, or may be implemented by the decoding processor 803. Similarly, each module in FIG. 7 may be implemented by the processing unit 804, or may be implemented by the decoding processor 803. However, the foregoing examples are merely exemplary, and are not intended to limit the embodiments of the present invention to this specific implementation manner.

The memory 805 stores instructions to enable the processing unit 804 or the decoding processor 803 to implement the following operations: Demultiplexing a received bitstream and decoding the demultiplexed bitstream to obtain a frequency domain signal; determining whether a highest frequency bin, to which a bit is allocated, of the frequency domain signal is less than a preset start frequency bin of a bandwidth extension frequency band; when the highest frequency bin to which a bit is allocated is less than the preset start frequency bin of the bandwidth extension frequency band, predicting an excitation signal of the bandwidth extension frequency band according to an excitation signal within a predetermined frequency band range of the frequency domain signal and the preset start frequency bin of the bandwidth extension frequency band; when the highest frequency bin to which a bit is allocated is greater than or equal to the preset start frequency bin of the bandwidth extension frequency band, predicting the excitation signal of the bandwidth extension frequency band according to the excitation signal within the predetermined frequency band range of the frequency domain signal, the preset start frequency bin of the bandwidth extension frequency band, and the highest frequency bin to which a bit is allocated; and predicting a bandwidth extension frequency band signal according to the predicted excitation signal of the bandwidth extension frequency band and a frequency envelope of the bandwidth extension frequency band.

The described apparatus embodiment is merely exemplary. The units described as separate parts may or may not be physically separate, and parts displayed as units may or may not be physical units, may be located in one position, or may be distributed on at least two network units. Some or all of the modules may be selected according to an actual need to achieve the objectives of the solutions of the embodiments. A person of ordinary skill in the art may understand and implement the embodiments of the present invention without creative efforts.

Finally, it should be noted that the foregoing embodiments are merely intended for describing the technical solutions of the present invention but not for limiting the present invention. Although the present invention is described in detail with reference to the foregoing embodiments, a person of ordinary skill in the art should understand that they may still make modifications to the technical solutions described in the foregoing embodiments or make equivalent replacements to some technical features thereof, without departing from the spirit and scope of the technical solutions of the embodiments of the present invention.

What is claimed is:

1. A method for predicting a bandwidth extension frequency band signal of an audio signal and performed by a decoding device comprising a processor, comprising:

demultiplexing a received bitstream;

decoding the demultiplexed bitstream to obtain a frequency domain signal;

determining whether a highest frequency bin, to which a bit is allocated, of the frequency domain signal is less than a preset start frequency bin of a bandwidth extension frequency band;

predicting an excitation signal of the bandwidth extension frequency band according to an excitation signal within a predetermined frequency band range of the frequency domain signal and the preset start frequency bin of the bandwidth extension frequency band when the highest frequency bin to which a bit is allocated is less than the preset start frequency bin of the bandwidth extension frequency band according to a process that comprises:

making n copies of the excitation signal within the predetermined frequency band range of the frequency domain signal; and using the n copies of the excitation signal as an excitation signal between the preset start frequency bin of the bandwidth extension frequency band and a highest frequency bin of the bandwidth extension frequency band, wherein n is greater than 0, and wherein n is equal to a ratio of a quantity of frequency bins between the preset start frequency bin of the bandwidth extension frequency band and the highest frequency bin of the bandwidth extension frequency band to a quantity of frequency bins within the predetermined frequency band range of the frequency domain signal;

predicting the excitation signal of the bandwidth extension frequency band according to the excitation signal within the predetermined frequency band range of the frequency domain signal, the preset start frequency bin of the bandwidth extension frequency band, and the highest frequency bin to which at least one bit is allocated when the highest frequency bin to which a bit is allocated is greater than or equal to the preset start frequency bin of the bandwidth extension frequency band;

predicting the bandwidth extension frequency band signal according to the predicted excitation signal of the bandwidth extension frequency band and a frequency envelope of the bandwidth extension frequency band; and reconstructing the audio signal based on the predicted bandwidth extension frequency band signal.

2. The method according to claim 1, wherein making n copies of the excitation signal within the predetermined frequency band range of the frequency domain signal, and using the n copies of the excitation signal as the excitation signal between the preset start frequency bin of the bandwidth extension frequency band and the highest frequency bin of the bandwidth extension frequency band comprises:

sequentially making integer copies in the n copies of the excitation signal within the predetermined frequency band range of the frequency domain signal and non-integer copies in the n copies of the excitation signal within the predetermined frequency band range of the frequency domain signal when the prediction is started from the preset start frequency bin of the bandwidth extension frequency band; and using the two parts of excitation signals as the excitation signal between the preset start frequency bin of the bandwidth extension frequency band and the highest frequency bin of the bandwidth extension frequency band, wherein the non-integer part of n is less than 1.

3. The method according to claim 1, wherein making n copies of the excitation signal within the predetermined frequency band range of the frequency domain signal, and using the n copies of the excitation signal as the excitation signal between the preset start frequency bin of the bandwidth extension frequency band and the highest frequency bin of the bandwidth extension frequency band comprises:

sequentially making non-integer copies in the n copies of the excitation signal within the predetermined frequency band range of the frequency domain signal and integer copies in the n copies of the excitation signal within the predetermined frequency band range of the frequency domain signal when the prediction is started from the highest frequency bin of the bandwidth extension frequency band; and using the two parts of excitation signals as the excitation signal between the preset start frequency bin of the bandwidth extension frequency band and the highest frequency bin of the bandwidth extension frequency band, and wherein the non-integer part of n is less than 1.

4. The method according to claim 1, wherein predicting the excitation signal of the bandwidth extension frequency band according to the excitation signal within the predetermined frequency band range of the frequency domain signal, the preset start frequency bin of the bandwidth extension frequency band, and the highest frequency bin, to which a bit is allocated comprises:

making a copy of an excitation signal from the $m^{th}$ frequency bin $f_{exc_start}+m$ above a start frequency bin $f_{exc_start}$ of the predetermined frequency band range of the frequency domain signal to an end frequency bin $f_{exc_end}$ of the predetermined frequency band range of the frequency domain signal and n copies of the excitation signal within the predetermined frequency band range of the frequency domain signal; and using the two parts of excitation signals as an excitation signal between the highest frequency bin, to which a bit is allocated, of the frequency domain signal and the highest frequency bin of the bandwidth extension frequency band, wherein n is no less than 0, m is a positive integer, and wherein m is equal to a value of a quantity of frequency bins between the highest frequency bin to which a bit is allocated and the preset start frequency bin of the bandwidth extension frequency band.

5. The method according to claim 4, wherein making the copy of the excitation signal from the $m^{th}$ frequency bin $f_{exc_start}+m$ above a start frequency bin $f_{exc_start}$ of the predetermined frequency band range of the frequency domain signal to the end frequency bin $f_{exc_end}$ of the predetermined frequency band range of the frequency domain signal and n copies of the excitation signal within the predetermined frequency band range of the frequency domain signal, and using the two parts of excitation signals as the excitation signal between the highest frequency bin, to which a bit is allocated, of the frequency domain signal and the highest frequency bin of the bandwidth extension frequency band comprises:

sequentially making a copy of the excitation signal that is of a low frequency band signal and from the $f_{exc_start}+m$ to the $f_{exc_end}$, integer copies in the n copies of the excitation signal that is of the low frequency band signal and from the $f_{exc_start}$ to the $f_{exc_end}$, and non-integer copies in the n copies of the excitation signal that is of the low frequency band signal and from the $f_{exc_start}$ to the $f_{exc_end}$ when the prediction is started from the highest frequency bin to which a bit is allocated; and using the three parts of excitation signals as the excitation signal between the highest frequency bin to which a bit is allocated and the highest frequency bin of the bandwidth extension frequency band, and wherein the non-integer part of n is less than 1.

6. The method according to claim 4, wherein making the copy of the excitation signal from the $m^{th}$ frequency bin $f_{exc_start}$+m above a start frequency bin $f_{exc_start}$ of the predetermined frequency band range of the frequency domain signal to the end frequency bin $f_{exc_end}$ of the predetermined frequency band range of the frequency domain signal and n copies of the excitation signal within the predetermined frequency band range of the frequency domain signal, and using the two parts of excitation signals as the excitation signal between the highest frequency bin, to which a bit is allocated, of the frequency domain signal and the highest frequency bin of the bandwidth extension frequency band comprises:

sequentially making non-integer copies in the n copies of the excitation signal that is of a low frequency band signal and from the $f_{exc_start}$ to the $f_{exc_end}$, integer copies in the n copies of the excitation signal that is of the low frequency band signal and from the $f_{exc_start}$ to the $f_{exc_end}$, and a copy of the excitation signal that is of the low frequency band signal and from the $f_{exc_start}$+m to the $f_{exc_end}$ when the prediction is started from the highest frequency bin of the bandwidth extension frequency band; and using the three parts of excitation signals as a high frequency excitation signal between the highest frequency bin to which a bit is allocated and the highest frequency bin of the bandwidth extension frequency band, wherein the non-integer part of n is less than 1.

7. The method according to claim 1, wherein, before predicting the bandwidth extension frequency band signal according to the predicted excitation signal of the bandwidth extension frequency band and the frequency envelope of the bandwidth extension frequency band, the method further comprises decoding the bitstream to obtain the frequency envelope of the bandwidth extension frequency band.

8. The method according to claim 1, wherein, before predicting the bandwidth extension frequency band signal according to the predicted excitation signal of the bandwidth extension frequency band and the frequency envelope of the bandwidth extension frequency band, the method further comprises:

decoding the bitstream to obtain a signal type; and acquiring the frequency envelope of the bandwidth extension frequency band according to the signal type.

9. The method according to claim 8, wherein acquiring the frequency envelope of the bandwidth extension frequency band according to the signal type comprises:

demultiplexing the received bitstream; and decoding the demultiplexed bitstream to obtain the frequency envelope of the bandwidth extension frequency band when the signal type is a non-harmonic signal.

10. The method according to claim 8, wherein acquiring the frequency envelope of the bandwidth extension frequency band according to the signal type comprises:

demultiplexing the received bitstream;

decoding the demultiplexed bitstream to obtain an initial frequency envelope of the bandwidth extension frequency band; and using a value that is obtained by performing weighting calculation on the initial frequency envelope and N adjacent initial frequency envelopes as the frequency envelope of the bandwidth extension frequency band when the signal type is a harmonic signal, and wherein N is greater than or equal to 1.

11. A decoding device for predicting a bandwidth extension frequency band signal of an audio signal, comprising:

a processor configured to:

demultiplex a received bitstream;

decode the demultiplexed bitstream to obtain a frequency domain signal;

determine whether a highest frequency bin, to which a bit is allocated, of the frequency domain signal is less than a preset start frequency bin of a bandwidth extension frequency band;

predict an excitation signal of the bandwidth extension frequency band according to an excitation signal within a predetermined frequency band range of the frequency domain signal and the preset start frequency bin of the bandwidth extension frequency band when the highest frequency bin to which at least one bit is allocated is less than the preset start frequency bin of the bandwidth extension frequency band;

make n copies of the excitation signal within the predetermined frequency band range of the frequency domain signal;

use the n copies of the excitation signal as an excitation signal between the preset start frequency bin of the bandwidth extension frequency band and a highest frequency bin of the bandwidth extension frequency band, wherein n is greater than 0, and wherein n is equal to a ratio of a quantity of frequency bins between the preset start frequency bin of the bandwidth extension frequency band and the highest frequency bin of the bandwidth extension frequency band to a quantity of frequency bins within the predetermined frequency band range of the frequency domain signal;

predict the excitation signal of the bandwidth extension frequency band according to the excitation signal within the predetermined frequency band range of the frequency domain signal, the preset start frequency bin of the bandwidth extension frequency band, and the highest frequency bin to which a bit is allocated when the highest frequency bin to which a bit is allocated is greater than or equal to the preset start frequency bin of the bandwidth extension frequency band;

predict a bandwidth extension frequency band signal according to the predicted excitation signal of the bandwidth extension frequency band and a frequency envelope of the bandwidth extension frequency band; and reconstruct the audio signal based on the bandwidth extension frequency band signal.

12. The device according to claim 11, wherein the processor is further configured to:

sequentially make integer copies in the n copies of the excitation signal within the predetermined frequency band range of the frequency domain signal and non-integer copies in the n copies of the excitation signal within the predetermined frequency band range of the frequency domain signal when the prediction is started from the preset start frequency bin of the bandwidth extension frequency band; and use the two parts of excitation signals as the excitation signal between the preset start frequency bin of the bandwidth extension frequency band and the highest frequency bin of the bandwidth extension frequency band, wherein the non-integer part of n is less than 1.

13. The device according to claim 11, wherein the processor is further configured to:

sequentially make non-integer copies in the n copies of the excitation signal within the predetermined frequency band range of the frequency domain signal and integer copies in the n copies of the excitation signal within the predetermined frequency band range of the frequency domain signal when the prediction is started from the highest frequency bin of the bandwidth extension frequency band; and use the two parts of excitation signals as the excitation signal between the preset start frequency bin of the bandwidth extension frequency band and the highest frequency bin of the bandwidth extension frequency band, wherein the non-integer part of n is less than 1.

14. The device according to claim 11, wherein the processor is further configured to:

make a copy of an excitation signal from the $m^{th}$ frequency bin $f_{exc_start}$+m above a start frequency bin $f_{exc_start}$ of the predetermined frequency band range of the frequency domain signal to an end frequency bin $f_{exc_end}$ of the predetermined frequency band range of the frequency domain signal and n copies of the excitation signal within the predetermined frequency band range of the frequency domain signal; and use the two parts of excitation signals as an excitation signal between the highest frequency bin, to which a bit is allocated, of the frequency domain signal and the highest frequency bin of the bandwidth extension frequency band, wherein n is no less than 0, wherein m is a positive integer, and wherein m is equal to a value of a quantity of frequency bins between the highest frequency bin to which a bit is allocated and the preset start frequency bin of the bandwidth extension frequency band.

15. The device according to claim 14, wherein the processor is further configured to:

sequentially make a copy of the excitation signal from the $f_{exc_start}$+m to the $f_{exc_end}$, integer copies in the n copies of the excitation signal from the $f_{exc_start}$ to the $f_{exc_end}$, and non-integer copies in the n copies of the excitation signal from the $f_{exc_start}$ to the $f_{exc_end}$ when the prediction is started from the highest frequency bin to which a bit is allocated; and use the three parts of excitation signals as the excitation signal between the highest frequency bin to which a bit is allocated and the highest frequency bin of the bandwidth extension frequency band, and wherein the non-integer part of n is less than 1.

16. The device according to claim 14, wherein the processor is further configured to:

sequentially make non-integer copies in the n copies of the excitation signal from the $f_{exc_start}$ to the $f_{exc_end}$, integer copies in the n copies of the excitation signal from the $f_{exc_start}$ to the $f_{exc_end}$, and a copy of the excitation signal from the $f_{exc_start}$+m to the $f_{exc_end}$ when the prediction is started from the highest frequency bin of the bandwidth extension frequency band; and use the three parts of excitation signals as a high frequency excitation signal between the highest frequency bin to which a bit is allocated and the highest frequency bin of the bandwidth extension frequency band, and wherein the non-integer part of n is less than 1.

17. The device according to claim 11, wherein the processor is further configured to decode the bitstream to obtain the frequency envelope of the bandwidth extension frequency band.

18. The device according to claim 11, wherein the processor is further configured to:

decode the bitstream to obtain a signal type; and acquire the frequency envelope of the bandwidth extension frequency band according to the signal type.

19. The device according to claim 18, wherein the processor is further configured to:

demultiplex the received bitstream; and decode the demultiplexed bitstream to obtain the frequency envelope of the bandwidth extension frequency band when the signal type is a non-harmonic signal.

20. The device according to claim 18, wherein the processor is further configured to:

demultiplex the received bitstream;

decode the demultiplexed bitstream to obtain an initial frequency envelope of the bandwidth extension frequency band; and use a value that is obtained by performing weighting calculation on the initial frequency envelope and N adjacent initial frequency envelopes as the frequency envelope of the bandwidth extension frequency band when the signal type is a harmonic signal, and wherein N is greater than or equal to 1.

* * * * *